US010705482B2

(12) United States Patent
Ueda et al.

(10) Patent No.: US 10,705,482 B2
(45) Date of Patent: Jul. 7, 2020

(54) ELECTRONIC AND IMAGE FORMING DEVICE WITH GAS VENTILATION

(71) Applicants: Yuta Ueda, Kanagawa (JP); Makoto Yoshioka, Saitama (JP); Kazuhiko Kobayashi, Tokyo (JP); Takushi Saito, Tokyo (JP)

(72) Inventors: Yuta Ueda, Kanagawa (JP); Makoto Yoshioka, Saitama (JP); Kazuhiko Kobayashi, Tokyo (JP); Takushi Saito, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/226,932

(22) Filed: Dec. 20, 2018

(65) Prior Publication Data

US 2019/0196396 A1 Jun. 27, 2019

(30) Foreign Application Priority Data

Dec. 27, 2017 (JP) ..... 2017-251941

(51) Int. Cl.
*G03G 15/20* (2006.01)
*G03G 21/20* (2006.01)

(52) U.S. Cl.
CPC ..... *G03G 21/206* (2013.01); *G03G 21/20* (2013.01)

(58) Field of Classification Search
USPC ..... 399/94
See application file for complete search history.

(56) References Cited

U.S. PATENT DOCUMENTS

2002/0191982 A1* 12/2002 Tsukamoto ..... G03G 15/104 399/94
2005/0195567 A1 9/2005 Natsume et al.
2011/0116826 A1* 5/2011 Nishikawa ..... G03G 21/206 399/92
2012/0328345 A1* 12/2012 Kunii ..... G03G 15/6585 399/341
2016/0195847 A1* 7/2016 Ikeda ..... B41J 11/007 399/94

FOREIGN PATENT DOCUMENTS

| | | |
|---|---|---|
| JP | 11-153894 | 6/1999 |
| JP | 2000-216580 | 8/2000 |
| JP | 2005-017881 | 1/2005 |
| JP | 2005-244018 | 9/2005 |
| JP | 2006-005065 | 1/2006 |
| JP | 2006-259423 | 9/2006 |
| JP | 2008-015047 | 1/2008 |
| JP | 2010-238706 | 10/2010 |
| JP | 2018-005198 | 1/2018 |

* cited by examiner

*Primary Examiner* — Quana Grainger
(74) *Attorney, Agent, or Firm* — Harness, Dickey & Pierce P.L.C.

(57) ABSTRACT

According to an embodiment, an electronic device includes a heat source, a discharge path, a wall internal space, and a heat conductor. The discharge path is configured to guide a gas toward the outside of the device. The wall internal space is surrounded by walls, extends vertically, and is open to a space outside the device via an upper opening and a lower opening that are in different vertical positions. The heat conductor includes a heat absorber that is positioned in the discharge path and a heat dissipater that is positioned in the wall internal space.

9 Claims, 31 Drawing Sheets

(a)

(b)

ELECTRONIC AND IMAGE FORMING DEVICE WITH GAS VENTILATION

CROSS-REFERENCE TO RELATED APPLICATIONS

The present application claims priority under 35 U.S.C. § 119 to Japanese Patent Application No. 2017-251941, filed on Dec. 27, 2017. The contents of which are incorporated herein by reference in their entirety.

BACKGROUND OF THE INVENTION

1. Field of the Invention

The present invention relates to an electronic device and an image forming device.

2. Description of the Related Art

Conventionally, electronic devices each including a heat source and a discharge path that guides a gas that is heated by heat that is generated by the heart source to the outside of the device have been known.

Japanese Unexamined Patent Application Publication No. 2005-17881 describes, as this type of electronic device, an image forming device that guides air that is heated by heat that is generated by a heat source, such as an image forming unit and a fixing unit, to the outside of the device via a discharge path in the discharge duct.

An electronic device, such as the image forming device described in Japanese Unexamined Patent Application Publication No. 2005-17881, configured to discharge heat by discharging a heated gas to the outside via a discharge path however has a risk that, when the amount of heat generated by the heat source increases, heat discharge may be insufficient and thus the temperature in the device may increase excessively.

SUMMARY OF THE INVENTION

According to an embodiment, an electronic device includes a heat source, a discharge path, a wall internal space, and a heat conductor. The discharge path is configured to guide a gas toward the outside of the device. The wall internal space is surrounded by walls, extends vertically, and is open to a space outside the device via an upper opening and a lower opening that are in different vertical positions. The heat conductor includes a heat absorber that is positioned in the discharge path and a heat dissipater that is positioned in the wall internal space.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
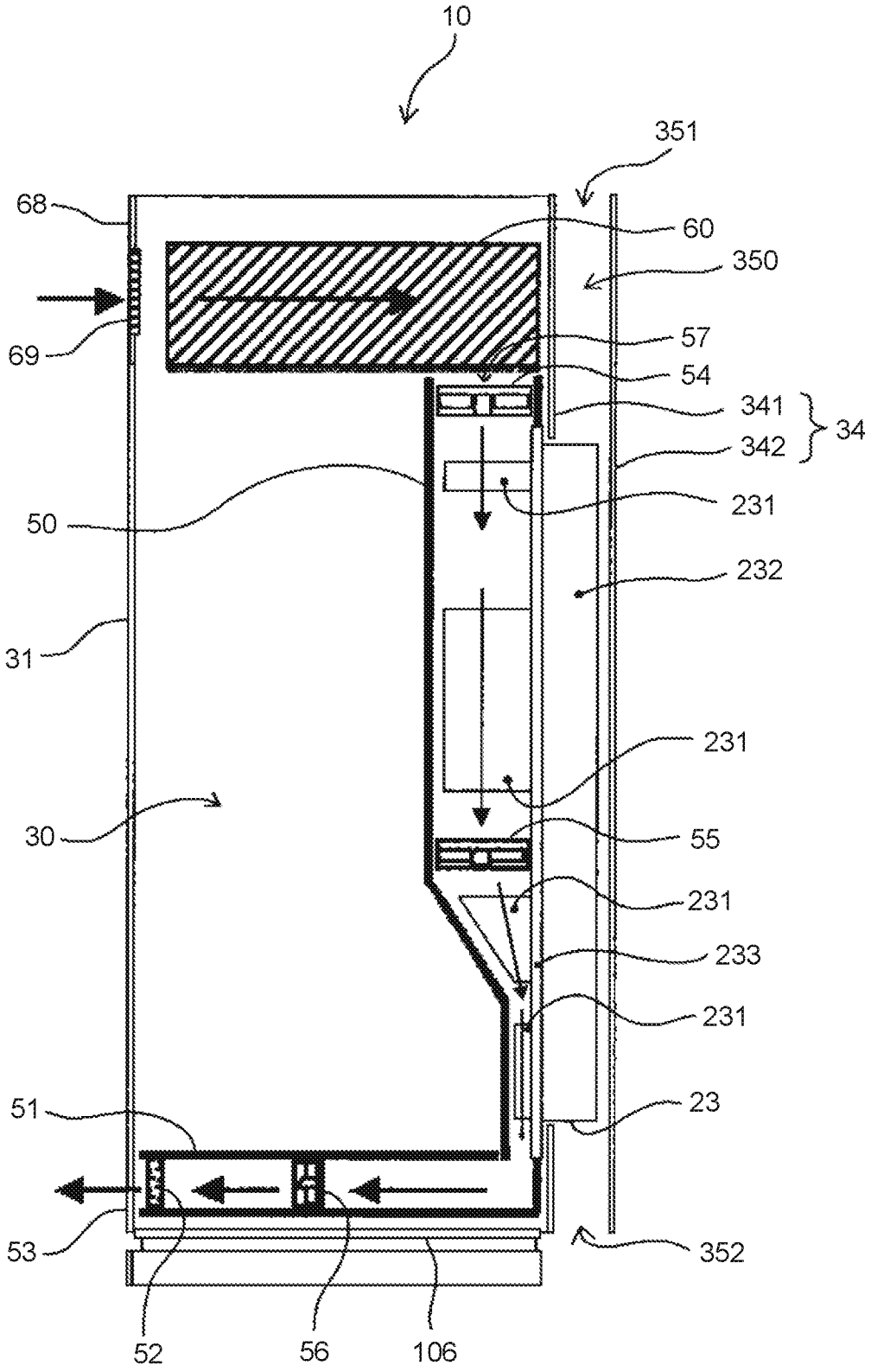
FIG. 1 is a schematic cross-sectional view of a copier viewed from the right side of the device.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

Embodiments where the present invention is applied to a copier (a copier 10 below) serving as an image forming device that is an electronic device will be described below.

Figure 2:
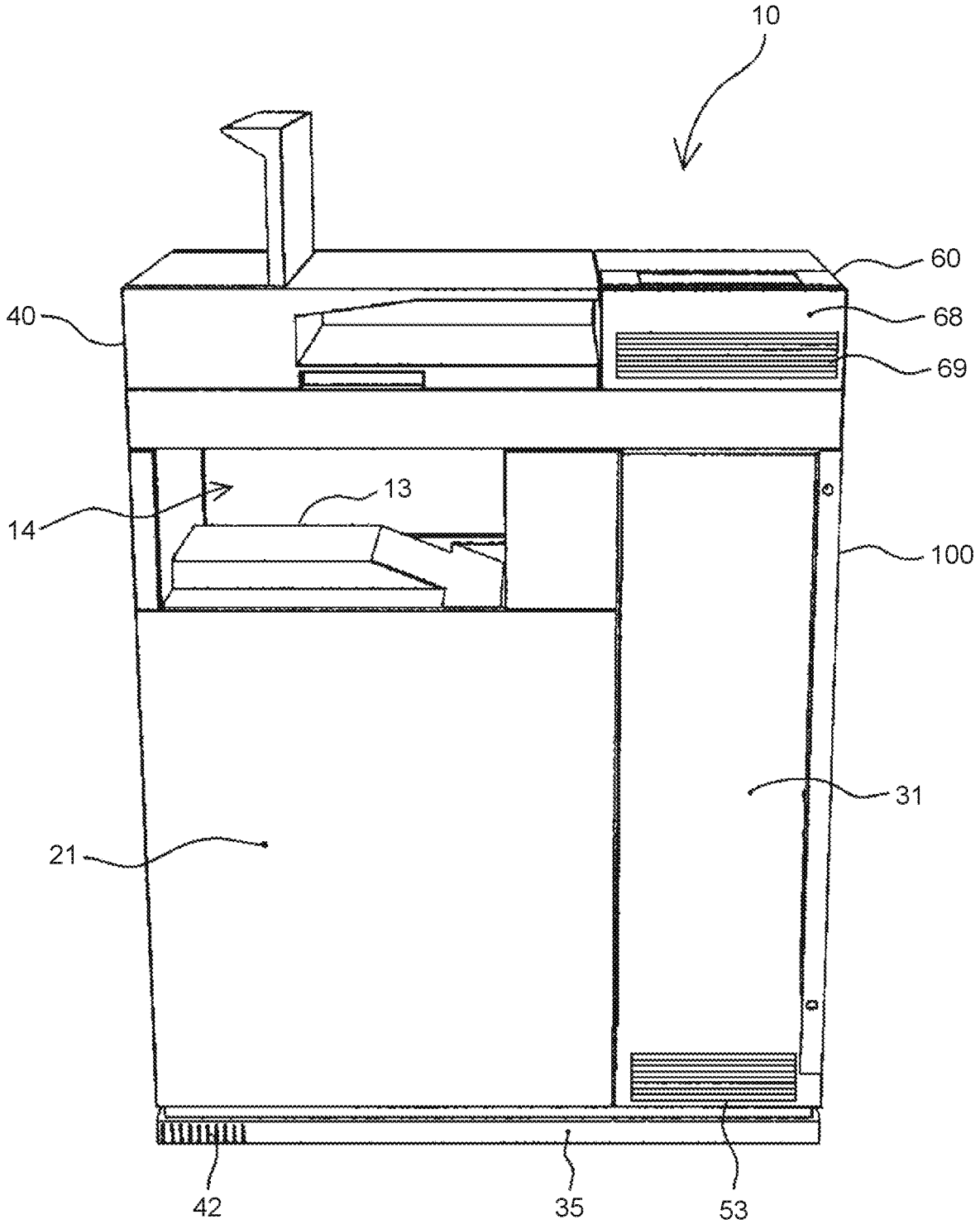
FIG. 2 is an external view of the copier of an embodiment viewed from the front side.

FIG. 2 is an external view of the copier 10 viewed from the front side. As illustrated in FIG. 2, the copier 10 includes an image-forming-unit front cover 21 and a jamming-processor front cover 31 as exterior covers on the front side.

Figure 3:
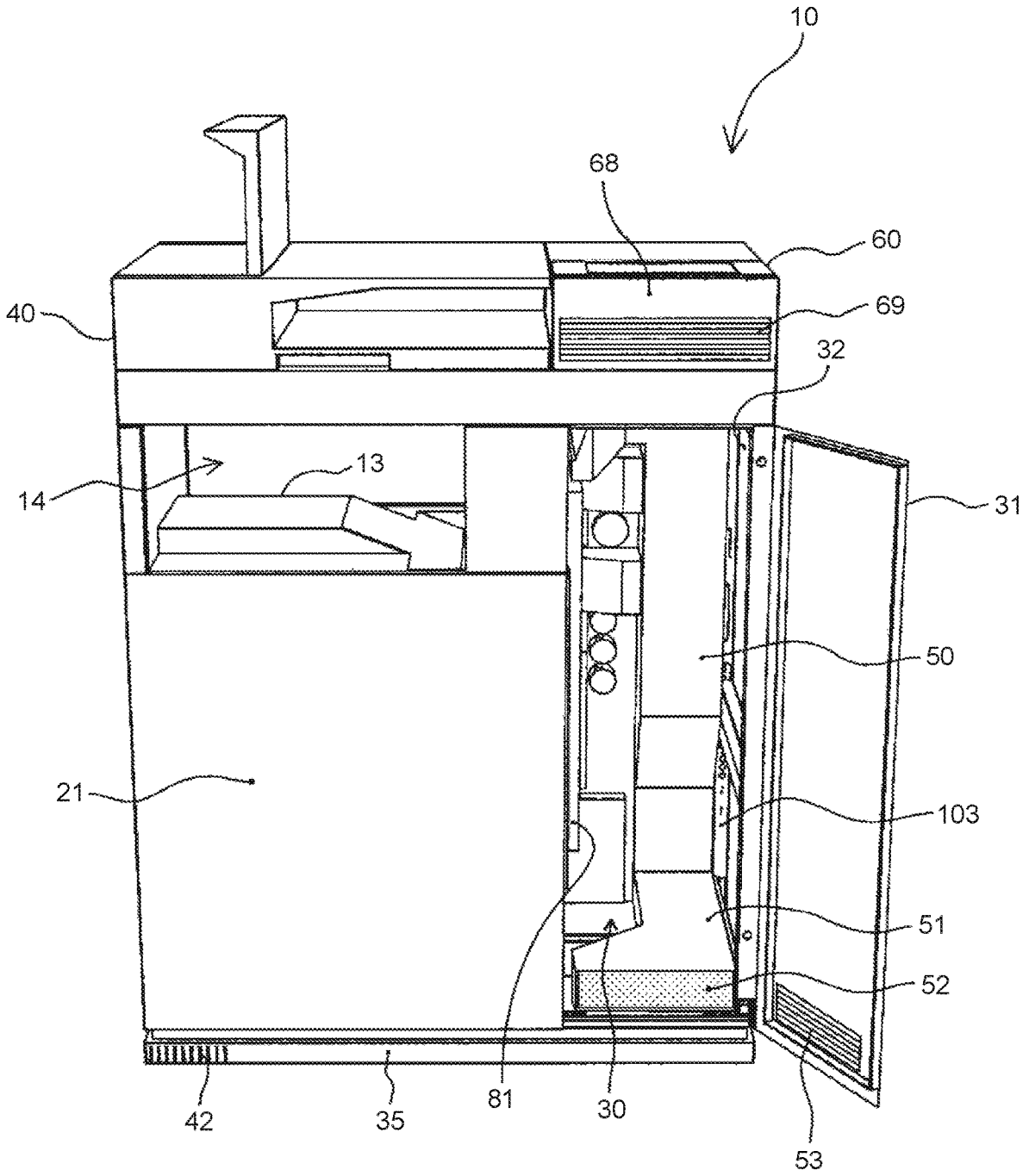
FIG. 3 is an external view of the copier viewed from the front side, with a jamming-processor front cover being opened.

FIG. 3 is an external view of the copier 10 illustrated in FIG. 2 and viewed from the front side, with the jamming-processor front cover 31 being opened. As illustrated in FIG. 3, when the jamming-processor front cover 31 is opened, a jamming process space 30 is exposed. In the jamming process space 30, a vertical discharge duct 50 that extends in a top-down direction and guides air whose temperature have increased in the device downward as air to be discharged and a horizontal discharge duct 51 that extends in an anteroposterior direction of the device and guides the air to be discharged and having passed through the vertical discharge duct 50 to the front side of the device are arranged. An air outlet 53 that discharges the air to be discharged and having passed through the vertical discharge duct 50 to the outside of the copier 10 is provided on the jamming-processor front cover 31 and a discharge filter 52 that captures solid particles in the air to be discharged is provided on an end of the horizontal discharge duct 51 on the front side of the device.

There is a jamming process pivoter 81 to be described below on the left side of the jamming process space 30 in FIG. 3. An operator who operates the jamming process opens the jamming-processor front cover 31 and thus the jamming process pivoter 81 can be operated.

Figure 4:
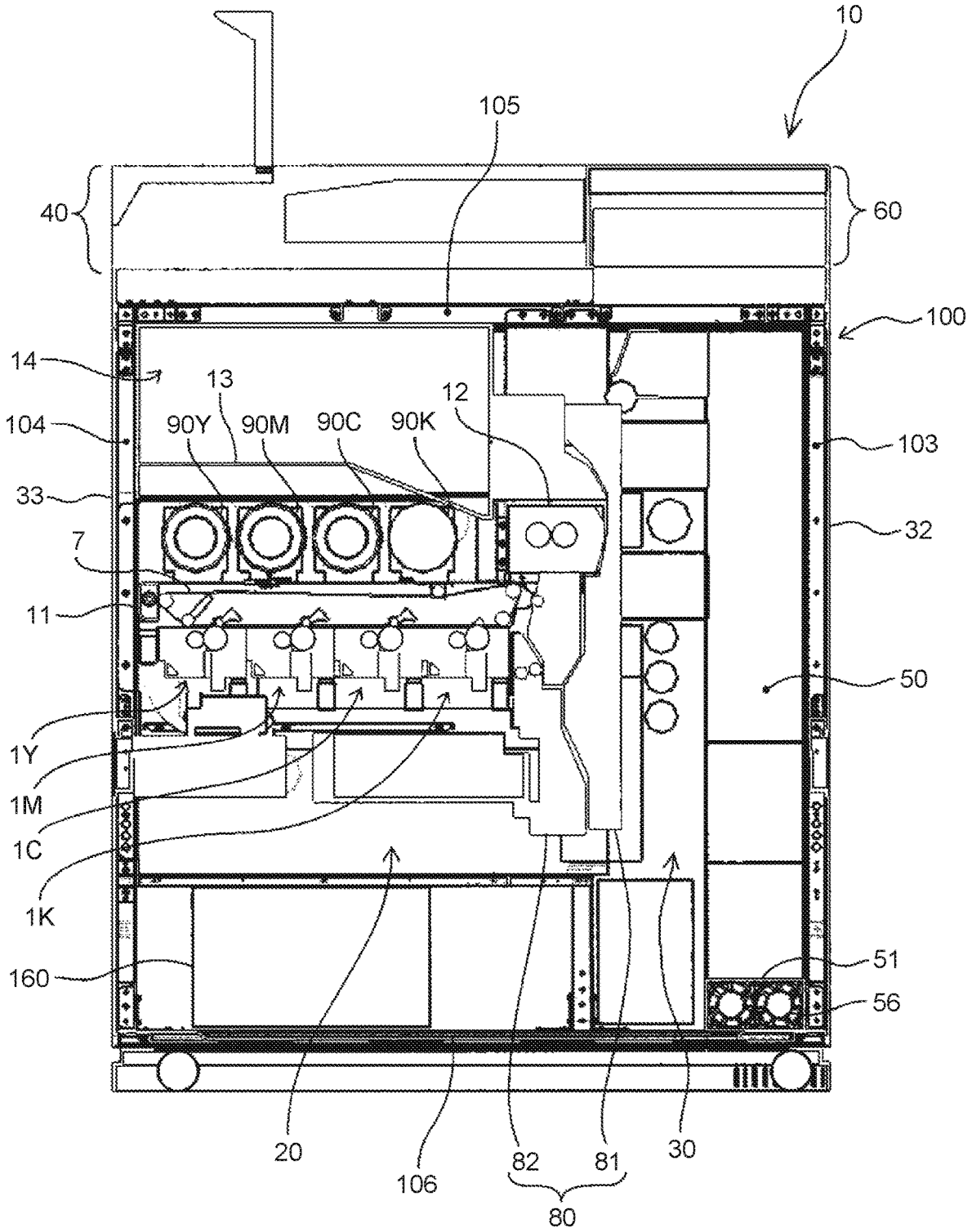
FIG. 4 is a cross-sectional view of the copier.

FIG. 4 is a cross-sectional view of the copier 10 illustrated in FIG. 2, illustrating the center part of the copier 10 in the device ante-posterior direction (in the front-back direction in FIG. 2).

As illustrated in FIG. 4, the copier 10 includes a printer unit 20 that is an image forming unit in a casing 100 that includes a frame and an exterior cover, a scanner unit 40 that is an image reading device above the printer unit 20, and an upper electronic unit 60 next to the scanner unit 40.

Figure 5:
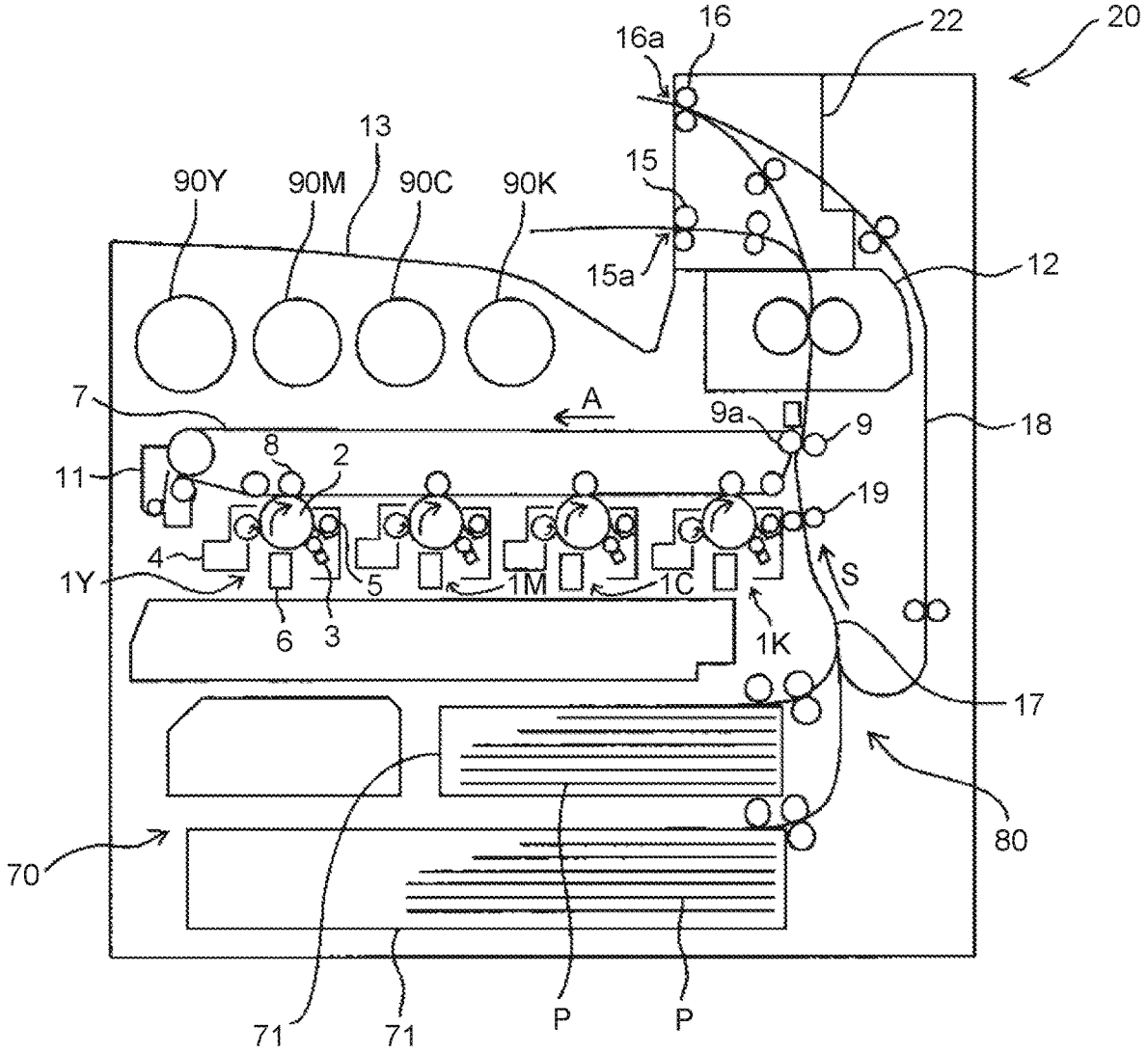
FIG. 5 is a schematic illustration of a printer unit that the copier includes.

FIG. 5 is a schematic illustration of the printer unit 20 that the copier 10 includes.

The printer unit 20 includes process cartridges 1 (Y, M, C and K) serving as four processing units, an intermediate transfer belt 7, and a fixing device 12 serving as a fixing unit. The intermediate transfer belt 7 is an intermediate transfer member that is tensioned across multiple belt tension rollers and that moves in the direction denoted by the arrow "A" in FIG. 5.

The subscripts Y, M, C and K added after the reference numbers of the four process cartridges 1 represent the modes: yellow, magenta, cyan and black. The four process cartridges 1 (Y, M, C and K) have approximately the same configuration except that the colors of toner to be used are different from one another and thus description will be given below without the subscripts Y, M, C and K.

The process cartridge 1 has a configuration in which a photoconductor 2 that is a latent image bearer, a charging member 3 that is a charger, a developing device 4 that is a developing unit, and a photoconductor cleaning device 5 that is a cleaning unit are integrally supported by the process cartridge 1 as a unit. Releasing the stopper of each of the process cartridges 1 enables the process cartridge 1 to be attachable to the device body of the copier 10.

The photoconductors 2 rotate clockwise in FIG. 5 as represented by the arrows in FIG. 5. The charging member 3 is a charging roller having a shape of roller. The charging member 3 is pushed against the surface of the photoconductor 2 as contacting the surface of the photoconductor 2 and rotates according to rotation of the photoconductor 2. To form an image, a given bias is applied by a high-voltage power supply to the charging member 3 and the charging member 3 charges the surface of the photoconductor 2. The process cartridge 1 of the embodiment uses the roller-shaped charging member 3 that contacts the surface of the photoconductor 2; however, the charging unit is not limited to the charging member 3, and a contactless charging system, such as corona charging, may be used.

An exposure device 6 causes the photoconductor 2 to be exposed to light based on image information of an image on an original that is read by the scanner unit 40 or image information that is input from an external device, such as a personal computer, to form a latent image on the surface of the photoconductor 2. In the embodiment, an LED array is used as the exposure device 6 and is arranged over the imaging area on the photoconductor 2 in the longitudinal direction (the direction orthogonal to the paper surface in FIG. 5).

A photoconductor cleaning device 5 cleans transfer residual toner remaining on the surface of the photoconductor 2 having passed through the position opposed to the intermediate transfer belt 7.

As illustrated in FIG. 5, the four process cartridges 1 are arranged in parallel in the direction in which the surface of the intermediate transfer belt 7 moves and form toner images of the respective colors that are yellow, cyan, magenta and black on the photoconductors 2, respectively. The four process cartridges 1 transfer the toner images that are formed on the respective photoconductors 2 onto the intermediate transfer belt 7 sequentially in a superimposed manner to form a visible image on the intermediate transfer belt 7.

As illustrated in FIG. 5, primary transfer rollers 8 serving as a primary transfer unit are respectively arranged in positions opposed to the respective four photoconductors 2 with the intermediate transfer belt 7 interposed in between. A primary transfer bias is applied by a high-voltage device to the primary transfer roller 8 to form a primary transfer electric field between the primary transfer roller 8 and the photoconductor 2. Formation of a primary transfer electric field between the photoconductor 2 and the primary transfer roller 8 causes the toner image that is formed on the surface of the photoconductor 2 to be transferred onto the surface of the intermediate transfer belt 7. Rotating one of the multiple belt tension rollers over which the intermediate transfer belt 7 is tensioned with a drive motor causes the surface of the intermediate transfer belt 7 to move in the direction denoted by the arrow "A" in FIG. 5. The toner images of the respective colors are sequentially transferred in a superimposed manner onto the surface of the intermediate transfer belt 7 whose surface moves and thus a full color image is formed on the surface of the intermediate transfer belt 7.

A secondary transfer roller 9 is arranged on the downstream side with respect to the position in which the four process cartridges 1 are opposed to the intermediate transfer belt 7 in the direction in which the surface of the intermediate transfer belt 7 moves. The secondary transfer roller 9 is arranged in a position opposed to a secondary transfer opposing roller 9*a* that is one of belt tension rollers with the intermediate transfer belt 7 interposed between the secondary transfer roller 9 and the secondary transfer opposing roller 9*a* and forms a secondary transfer nip between the secondary transfer roller 9 and the intermediate transfer belt 7. A given voltage is applied between the secondary transfer roller 9 and the secondary transfer opposing roller 9*a* to form a secondary transfer electric field.

The printer unit 20 includes a paper feeding device 70 that includes multiple paper feeding trays 71 under the four process cartridges 1. The printer unit 20 further includes a paper conveyance device 80 that includes a fed-paper conveyance path 17 and an inversion conveyance path 18 on the right side of the intermediate transfer belt 7 in FIG. 5. The fed-paper conveyance path 17 is configured to convey a transfer paper P from the lower side to the upper side and the inversion conveyance path 18 is configured to convey the transfer paper P from the upper side to the lower side, and the paper conveyance device 80 is a longitudinal conveyance sheet conveyance device that conveys the transfer paper P in the up-down direction.

The transfer paper P that is fed from any one of multiple paper feeding trays 71 of a paper feeding device 70 is guided to the fed-paper conveyance path 17 of the paper conveyance device 80 and bumps against a registration roller pair 19 and stops. The registration roller pair 19 starts driving to cause the transfer paper P to reach the secondary transfer nip according to the timing at which the toner image on the intermediate transfer belt 7 reaches the secondary transfer nip and accordingly the transfer paper P is conveyed to the secondary transfer nip. When the transfer paper P passes through the secondary transfer nip, the secondary transfer electric field that is formed between the secondary transfer roller 9 and the secondary transfer opposing roller 9*a* causes the full color image, which is formed on the surface of the intermediate transfer belt 7, to be transferred onto the transfer paper P.

In the printer unit 20, the fixing device 12 is arranged on the downstream side in the direction S in which the transfer paper P is conveyed with respect to the secondary transfer nip. The transfer paper P having passed through the secondary transfer nip reaches the fixing device 12. The heat and compression at the fixing device 12 fixes the full-color image transferred onto the transfer paper P. In single-sided printing or when an image is formed on a second surface in double-sided printing, the paper ejection roller pair 15 outputs the transfer paper P with the fixed image thereon to a ejected-paper tray 13 of a body internal paper ejection unit 14 of the copier 10 from a paper ejection opening 15*a*.

On the other hand, when an image is formed on a first surface in double-sided printing, the transfer paper P with the fixed image thereon is conveyed to an inversion roller pair 16. The tip side of the transfer paper P passes through the inversion roller pair 16 and comes into the body internal paper ejection unit 14 from the inversion opening 16*a* and, before the back end of the transfer paper P passes through the inversion roller pair 16, the inversion roller pair 16 rotates inversely to guide the transfer paper P to the inversion conveyance path 18. The transfer paper P having passed through the inversion conveyance path 18 is guided to the fed-paper conveyance path 17 again and bumps against the registration roller pair 19. An image is then formed on the second surface and the transfer paper P is output to the ejected-paper tray 13.

The toner that is not transferred onto the transfer paper P at the secondary transfer nip and remains on the surface of the intermediate transfer belt 7 is collected by a transfer belt cleaning device 11.

As illustrated in FIG. 5, above the intermediate transfer belt 7, toner bottles 90 (Y, M, C and K) that store the respective color toners are detachably arranged on the device body of the copier 10.

The toners that are stored in the toner bottles 90 of the respective colors are supplied by toner supply devices corresponding to the respective colors to the developing devices 4 corresponding to the respective colors.

As illustrated in FIG. 4, in the copier 10, the printer unit 20 is arranged on the left side in the casing 100 to provide the jamming process space 30 on the right of the printer unit 20 in the casing 100.

Figure 6:
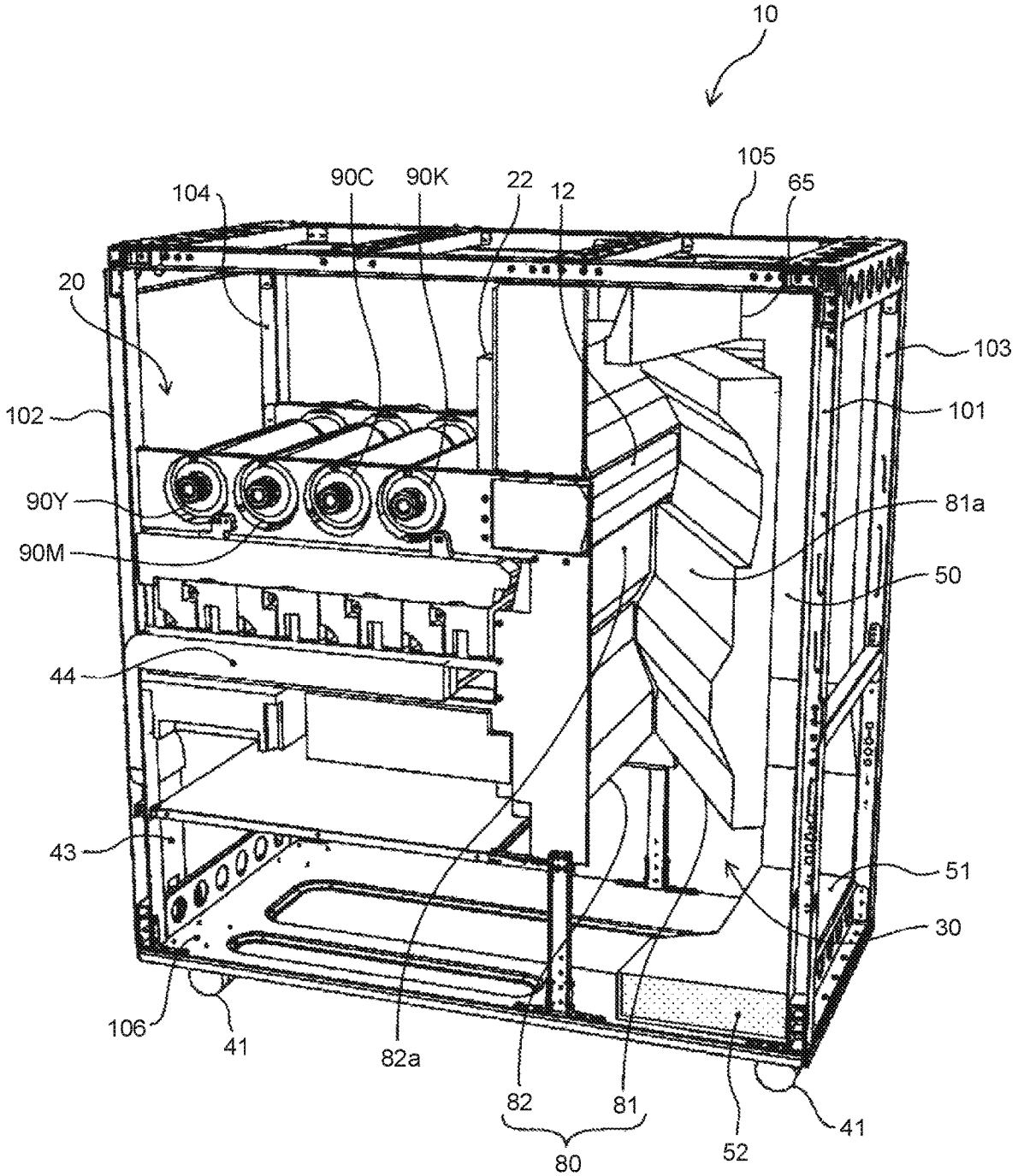
FIG. 6 is a perspective view of the copier with its exterior cover, etc., being detached.

FIG. 6 is a perspective view of the scanner unit 40, the upper electronic unit 60 and the copier 10 with its exterior covers being detached.

As illustrated in FIG. 6, the copier 10 includes a front-surface right frame 101, a front-surface left frame 102, a back-surface right frame 103, a back-surface left frame 104, a bottom-surface frame 106 and a top-surface frame 105.

As illustrated in FIG. 4, the copier 10 includes a board-shaped right-surface exterior cover 32 as an exterior cover on the right side surface of the copier 10 such that the space between the front-surface right frame 101 and the back-surface right frame 103 is covered. As illustrated in FIG. 4, the copier 10 includes a board-shaped left-surface exterior cover 33 as an exterior cover on the left side surface of the copier 10 such that the space between the front-surface left frame 102 and the back-surface left frame 104 is covered.

The copier 10 further includes a board-shaped back-surface exterior cover 34 as an exterior cover on the back side of the copier 10 such that the space between the back-surface right frame 103 and the back-surface left frame 104 is covered (see FIG. 7 to be described below).

As illustrated in FIG. 6, the copier 10 includes casters 41 that support the bottom-surface frame 106 and, as illustrated in FIG. 2, further includes a front lower exterior cover 35 that conceals the casters 41 when viewed from the front of the device. A front-side air inlet 42 is provided in the vicinity of the left end of the front lower exterior cover 35 in FIG. 2.

The front lower exterior cover 35 is detachable from the body of the copier 10, is detached when the copier 10 is moved by using the casters 41, and is attached to the copier 10 after the copier 10 is moved to a setting position.

In the copier 10, the above-descried frames and exterior covers form the casing 100.

Figure 7:
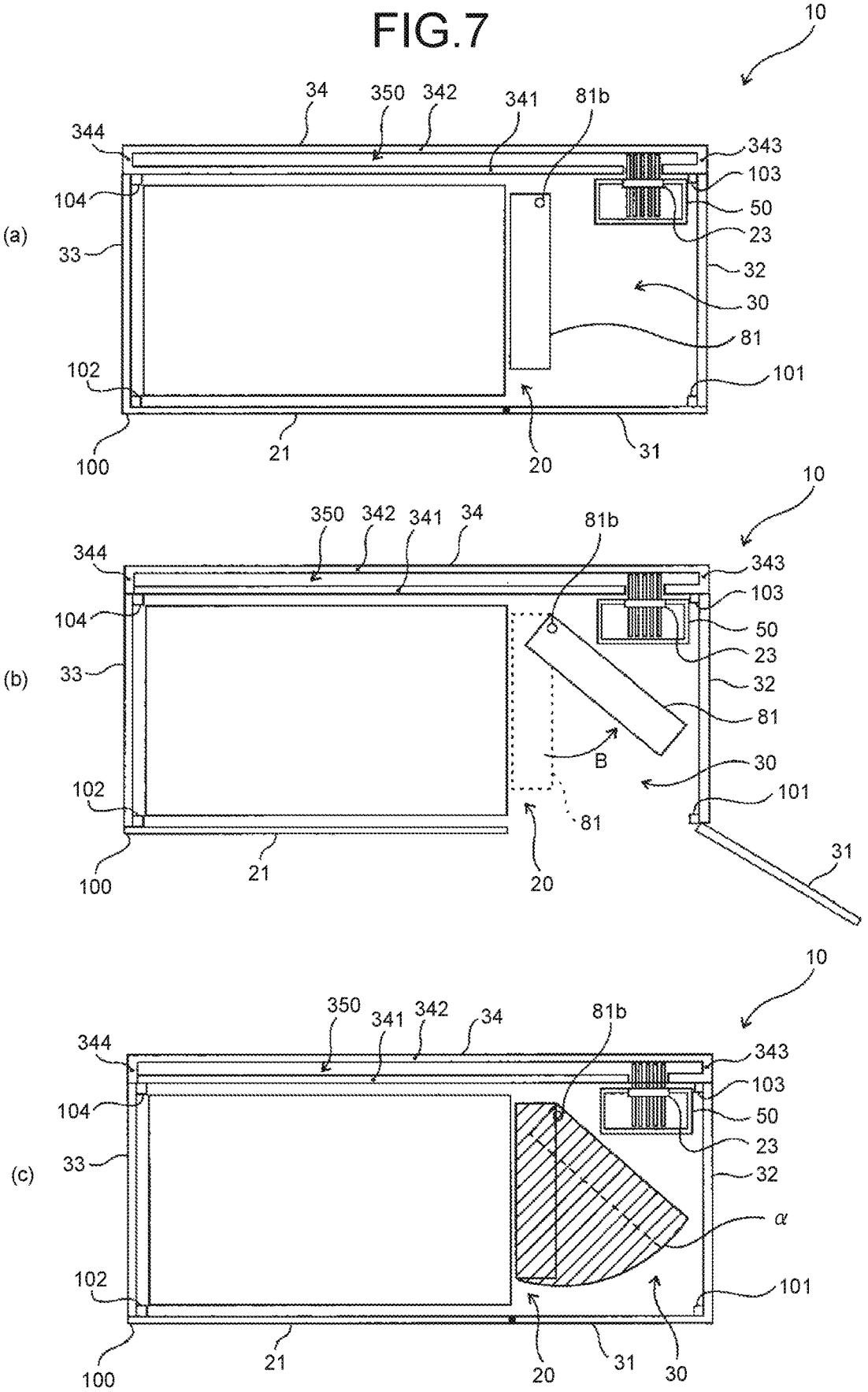
FIG. 7 includes plane views schematically illustrating a positional relationship between the space in a casing of the copier and a jamming process pivoter, where a section (a) illustrates a closed state, a section (b) illustrates an opened state and a section (c) illustrates a move area in the casing.

FIG. 7 is a plane view schematically illustrating a positional relationship between the space in the casing 100 of the copier 10 and the jamming process pivoter 81, where a section (a) illustrates a state where the jamming process pivoter 81 is closed, a section (b) illustrates a state where the jamming process pivoter 81 is opened and a section (c) illustrates a move area α in which the jamming process pivoter 81 moves in the casing 100.

As illustrated in FIGS. 6 and 7, the paper conveyance device 80 includes the jamming process pivoter 81 that is pivotable on a jamming process pivot shaft 81*b* that extends in the top-down direction on the back side (back) of the copier 10 and a jamming process fixing unit 82 that is fixed to the printer unit 20.

The copier 10 performs image forming with the jamming process pivoter 81 being in a closed state as illustrated in the section (a) of FIG. 7 and with the image-forming-unit front cover 21 and the jamming-processor front cover 31 being in the closed as illustrated in the section (a) of FIG. 7 and FIG. 2. In image forming, the paper conveyance device 80 conveys the transfer paper P and an image is formed on the transfer paper P.

When paper jamming occurs in the fed-paper conveyance path 17 and the inversion conveyance path 18 of the paper conveyance device 80, the operator opens the jamming-processor front cover 31 as illustrated in the section (b) of FIG. 7 and FIG. 3 to expose the jamming process pivoter 81 in the jamming process space 30. The jamming process pivoter 81 is then caused to pivot on the jamming process pivot shaft 81*b* in the direction denoted by the arrow "B" in the section (b) of FIG. 7 so that, as illustrated in the section (b) of FIG. 7 and FIG. 6, the jamming process pivoter 81 enters an opened state. Accordingly, as illustrated in FIG. 6, a pivoter inner side surface 81*a* of the jamming process pivoter 81 and a fixing-unit inner side surface 82*a* of the jamming process fixing unit 82 are exposed.

When paper jamming occurs in the fed-paper conveyance path 17, the fixing-unit inner open-close cover that is pivotable on a pivot shaft that is provided on the fixing-unit inner side surface 82*a* and that extends vertically is opened to expose the fed-paper conveyance path 17 and the transfer paper P jammed in the fed-paper conveyance path 17 is removed.

When paper jamming occurs in the inversion conveyance path 18, a fixing-unit inner open-close cover that is provided on a pivoter inner side surface 81*a* and that extends vertically is opened to expose the inversion conveyance path 18 and the transfer paper P jammed in the inversion conveyance path 18 is removed.

As described above, when paper jamming occurs in the fed-paper conveyance path 17 or the inversion conveyance path 18, the jamming process pivoter 81 is caused to enter the opened state to perform the jamming process to remove the transfer paper P that is the cause of paper jamming.

As the paper conveyance device 80 of the copier 10 conveys the transfer paper P in the top-down direction, moving the jamming process pivoter 81 in the left-right direction enables the paper conveyance path 17 and the inversion conveyance path 18 that convey the transfer paper P in the longitudinal direction to be exposed.

As illustrated in FIG. 7, etc., the copier 10 has the jamming-process space 30, in the casing 100, in which the jamming process pivoter 81 is opened to perform the jamming process.

Furthermore, the vertical discharge duct 50 that extends in the top-down direction is provided in an area other than the move area α that is a cover-member open-close-time passing-through space through which the jamming process pivoter 81 in the jamming process space 30 passes when moving between the closed state and the opened state.

As illustrated in FIG. 2, in the copier 10, the front-side air inlet 42 and the air outlet 53 are provided in the front surface of the copier 10. In the copier 10, the air to be discharged is guided via a horizontal discharge duct 51 from the vertical discharge duct 50 that is arranged on the back side of the device to the air outlet 53 that is arranged on the front-side end of the device.

Figure 8:
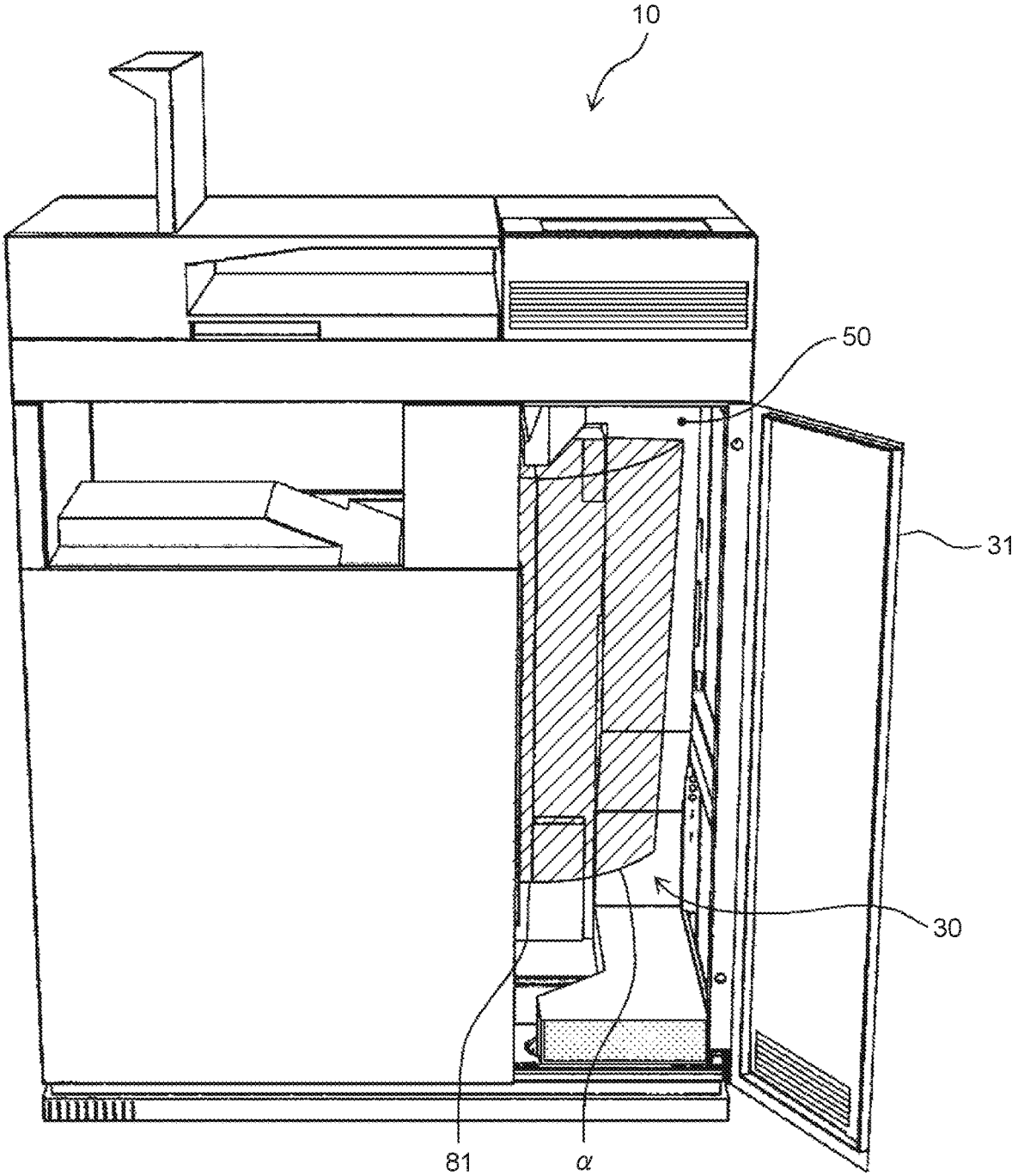
FIG. 8 is an illustration obtained by adding the move area to the external view represented in FIG. 3.

FIG. 8 is an illustration obtained by adding the move area α in which the jamming process pivoter 81 moves to the external view represented in FIG. 3. The jamming process pivoter 81 and the vertical discharge duct 50 are arranged such that, when the copier 10 is viewed from the font, the projection view of the move area α and the projection view of the vertical discharge duct 50 overlap at least partly as illustrated in the section (c) of FIG. 7 and FIG. 8. In other words, the jamming process pivoter 81 and the vertical discharge duct 50 are arranged such that, when the jamming process pivoter 81 is in the opened state, the vertical discharge duct 50 is positioned on the back side of the jamming process pivoter 81 as illustrated in the section (b) of FIG. 7 and FIG. 6. This enables inhibition of the copier 10 from increasing in size in the left-right direction.

In the copier 10, the jamming process space 30 is provided such that the move area α in which the jamming process pivoter 81 that pivots on the jamming process pivot shaft 81*b* that is provided on the back side and that extends vertically is within the casing 100; however, as the angle at which the jamming process pivoter 81 pivots is under 90 degrees, there is a dead space that does not contribute to securing the move area α on the right back side of the jamming process space 30. From the viewpoint of securing the move area α, arranging the vertical discharge duct 50 in the area serving as the dead space enables utilization of the spare space in the jamming process space 30. This enables inhibition of the copier 10 in which the jamming process space 30 is provided in the casing 100 from increasing in size.

As illustrated in the section (c) of FIG. 7, there is also an area that does not contribute to securing the move area α in which the jamming process pivoter 81 moves on the right front side of the jamming process space 30. When a member that is fixed to the device body, such as the vertical discharge duct 50, is arranged in the area, there is a risk that, when the jamming process pivoter 81 is in the opened state, the front side of the jamming process pivoter 81 may be blocked by the member fixed to the device body and this may prevent the jamming process. It is therefore preferable that, when the member that is fixed to the device body is arranged on the right front side of the jamming process space 30, the member be arranged as not preventing the jamming process.

The copier 10 has the configuration in which the jamming process pivoter 81 pivots on the jamming process pivot shaft 81*b* that extends vertically; however, the configuration to secure the move area α in the casing 100 is not limited to this.

Figure 9:
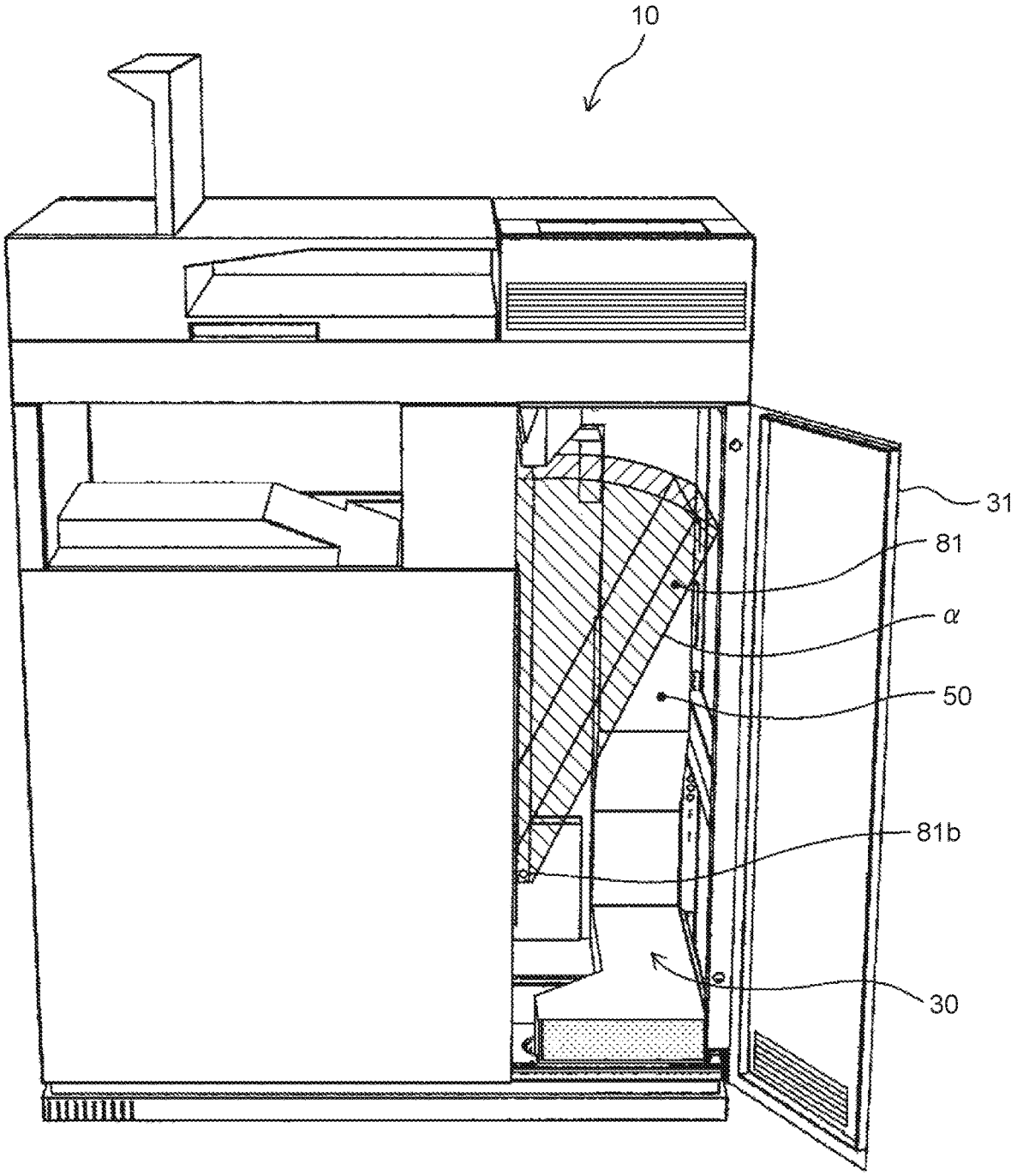
FIG. 9 is an illustration obtained by adding a move area to the external view of the copier that is viewed from the front side, where the jamming process pivoter pivots on a pivoter inner surface of the pivoter, which is the inner surface extending horizontally.

FIG. 9 is an illustration obtained by adding a move area α to the external view of the copier 10 viewed from the front side, where the jamming process pivoter 81 pivots on a pivot shaft that extends horizontally.

Figure 10:
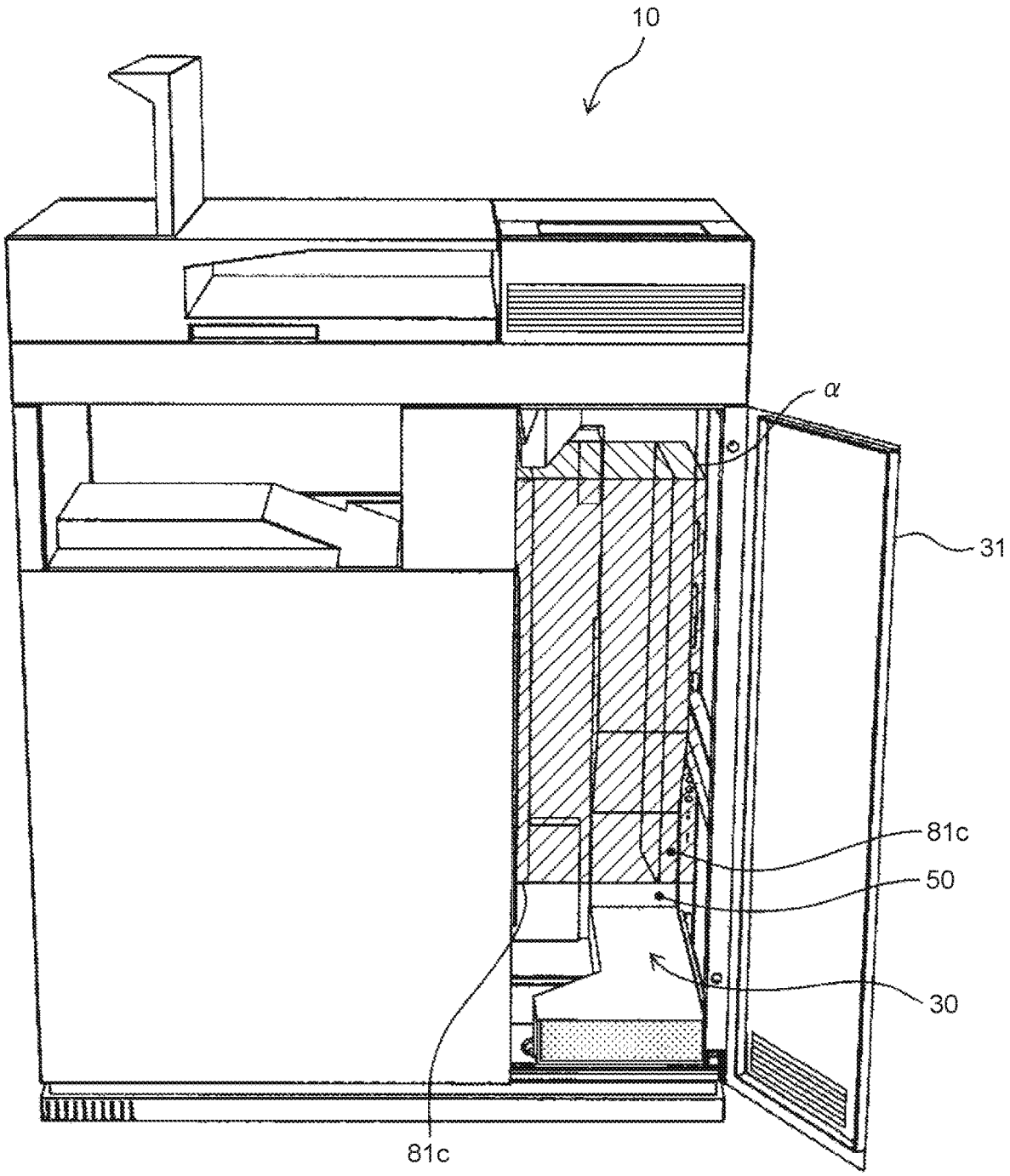
FIG. 10 is an illustration obtained by adding a move area to the external view of the copier including a jamming process slider viewed from the front side.

FIG. 10 is an illustration obtained by adding a move area α to the external view of the copier 10 that is viewed from the front side and configured to include, instead of the jamming process pivoter 81, a jamming process slider 81*c* that slides in the left-right direction to cause the path in which the transfer paper P is conveyed to be exposed.

Also in the configurations illustrated in FIG. 9 and FIG. 10, the jamming process pivoter 81 or the jamming process slider 81*c* and the vertical discharge duct 50 are arranged such that, when the copier 10 is viewed from the front, the move area α and the vertical discharge duct 50 overlap at least partly. This enables inhibition of the copier 10 in which the jamming process space 30 is provided in the casing 100 from increasing in size.

Figure 11:
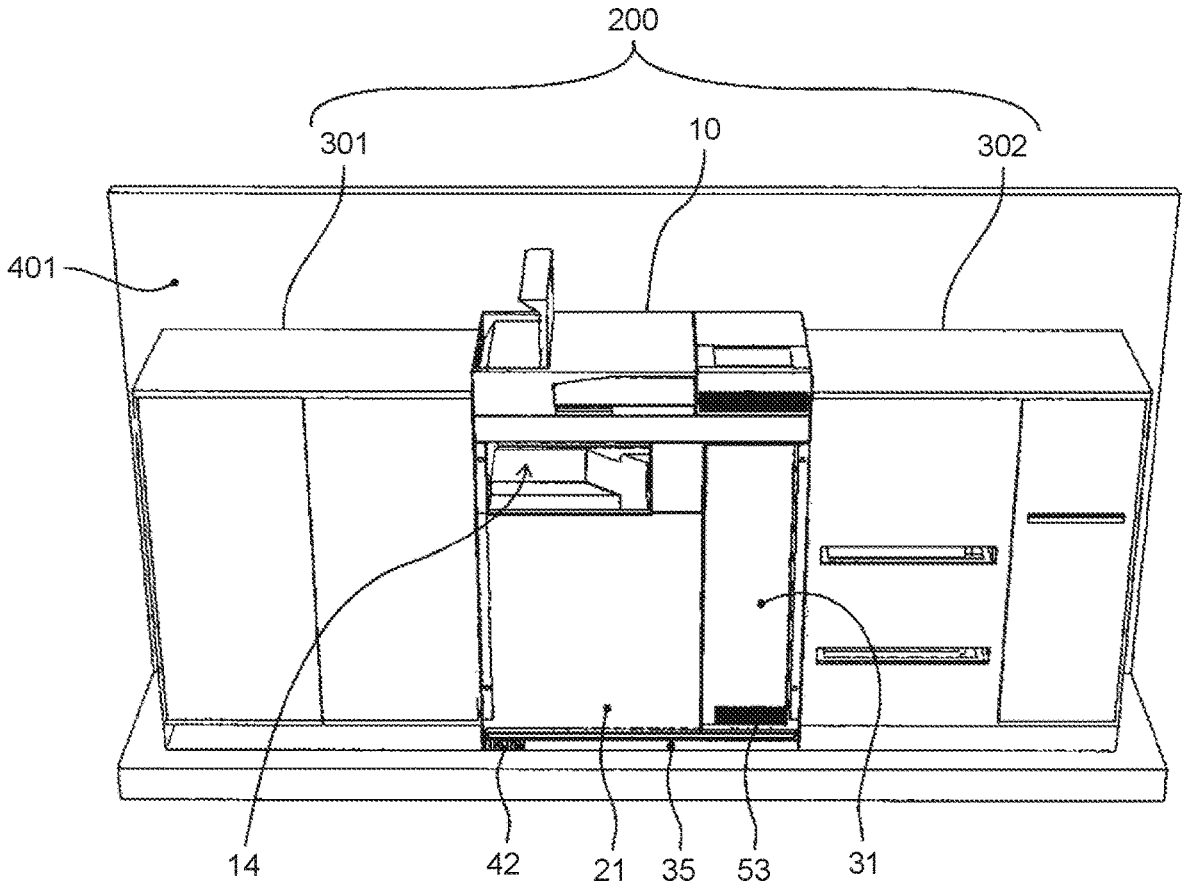
FIG. 11 is an external view of the copier viewed from the front side, illustrating exemplary setting of the copier.
Figure 12:
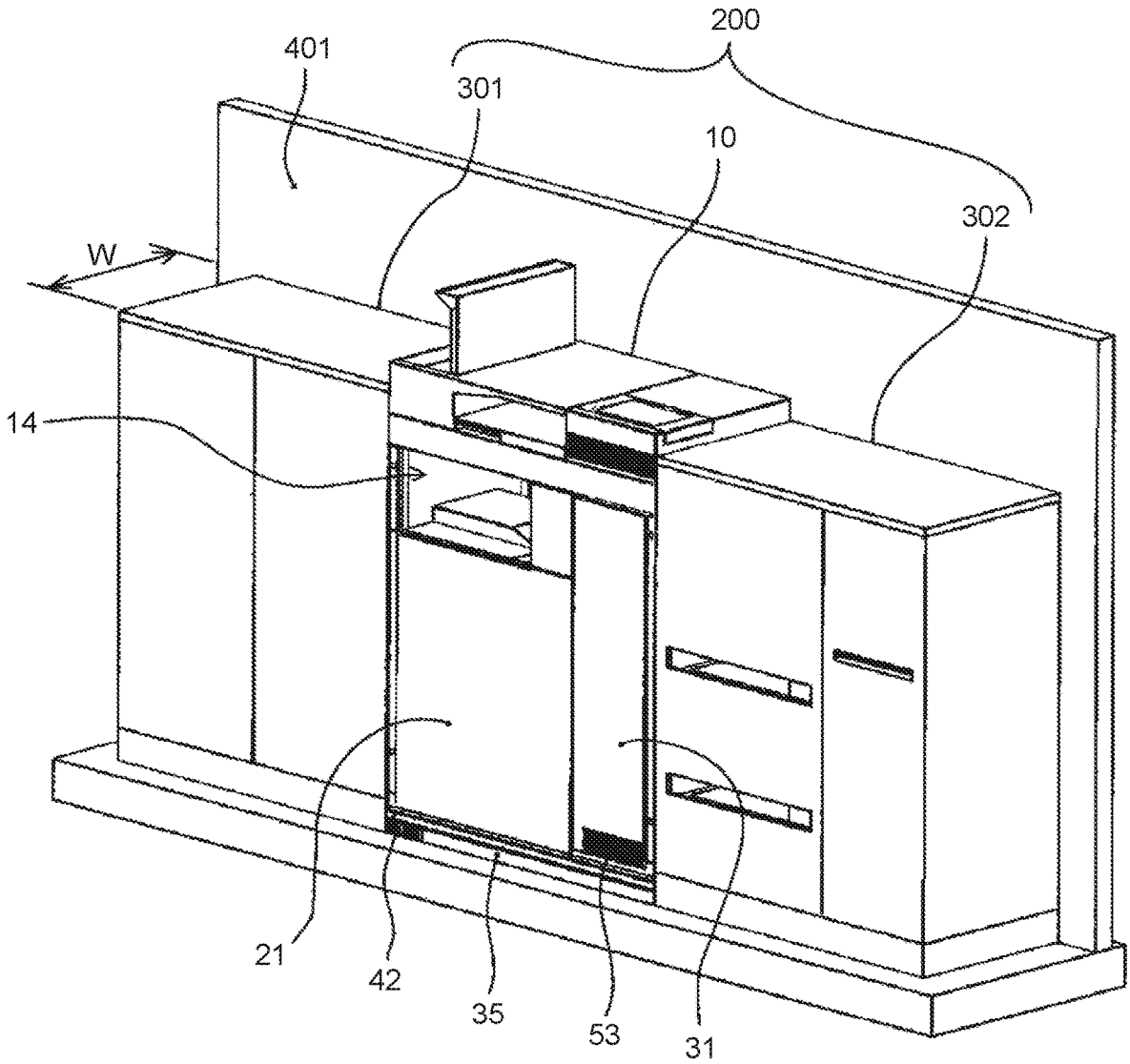
FIG. 12 is an external view of the copier viewed obliquely, illustrating the exemplary setting of the copier.

FIG. 11 is an external view of the copier 10 of the embodiment viewed from the front side, illustrating exemplary setting of the copier 10, and FIG. 12 is an external view of the copier 10 illustrated in FIG. 11 viewed obliquely, illustrating the exemplary setting of the copier 10.

In the exemplar setting illustrated in FIG. 11 and FIG. 12, a first cabinet 301 capable of storing a bundle of transfer papers P that is set on the paper feeding tray 71 on the left of the copier 10. Furthermore, a second cabinet 302 capable of storing supplies, such as the process cartridges 1 and the toner bottle 90, and a document disposal box is set on the right of the copier 10.

Figure 33:
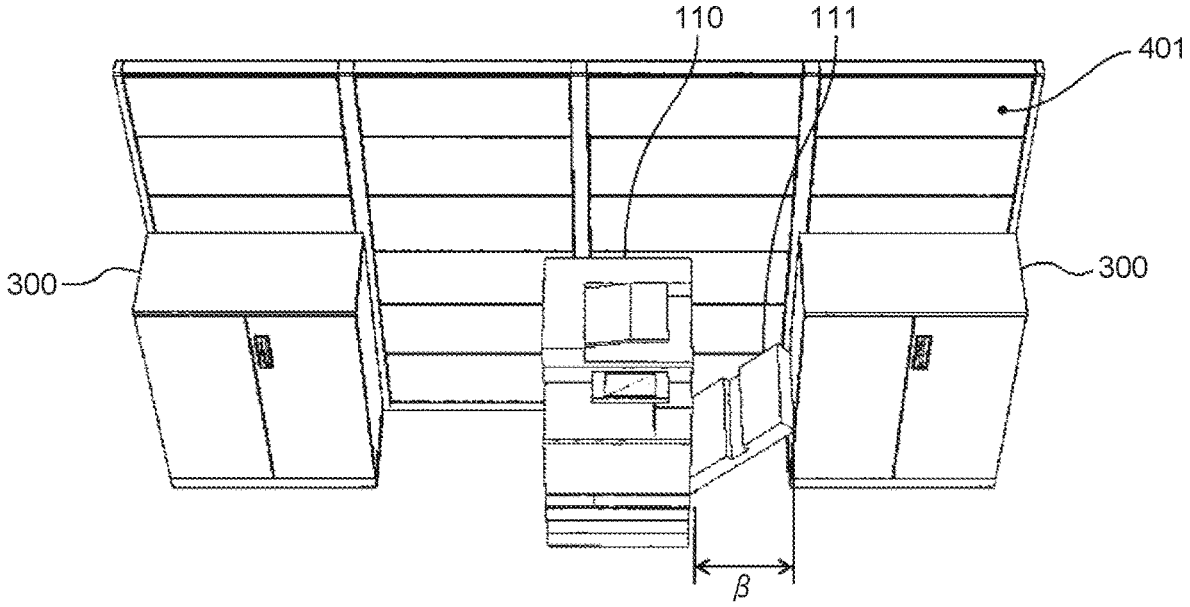
FIG. 33 is an external view of a conventional exemplary device that is an exemplary conventional image forming device viewed from the front side, illustrating exemplary setting of the exemplary conventional image forming device.

FIG. 33 is an external view of an exemplary conventional device 110 that is an exemplary conventional image forming device viewed from the front side, illustrating exemplary setting of the exemplary conventional device 110. In the conventional image forming device, in general, a conveyance path cover member that is open in the left-right direction of the device when the jamming process on a sheet conveyance path that conveys a sheet longitudinally, such as the transfer paper P, from the upper side to the lower side is performed is a side-surface exterior cover 111.

When the exemplary conventional device 110 is set, it is required to set storages, such as a cabinet 300, furniture and electronic devices, with the cover-member open-close-time passing-through space (area "β" in FIG. 33), through which the side-surface exterior cover 111 functioning as a conveyance path cover member passes when opened and closed, being secured. As it is not possible to set storages, furniture and electronic devices in the vicinity of the outer side of the side-surface exterior cover 111, there is a clearance on the side of the exemplary conventional device 110 with the side-surface exterior cover 111, which is the conveyance path cover member, being closed and this causes aesthetic loss in the setting state.

On the other hand, in the copier 10, the jamming process space 30 is provided in the casing 100 and, as illustrated in FIGS. 7 and 4, includes the board-shaped right-surface exterior cover 32 outside the jamming process space 30.

In the copier 10, as the jamming process space 30 containing the move area α that is the cover-member open-close-time passing-through space is provided in the casing 100, it is unnecessary to secure the cover-member open-close-time passing-through space outside the casing 100. For this reason, as illustrated in FIG. 11 and FIG. 12, it is possible to perform arrangement allowing the side surfaces of the first cabinet 301 and the second cabinet 302 to be in the vicinity of or contact the side surfaces of the copier 10 and thus enables aesthetic improvement of the setting state.

In the copier 10, air that is sucked from the front-side air inlet 42 because of suction by a suction fan 47 to be described below with reference to FIGS. 18 and 19, etc., enters an area under the bottom-surface frame 106 on the inner side with respect to the front lower exterior cover 35. The air then passes through the bottom-surface-frame opening 48 to be described blow with reference to FIGS. 18 and 19 and the suction fan 47 and is supplied to the heat sources to be cooled, such as the image forming unit in which the four process cartridges 1 are arranged and the fixing device 12, via a vertical intake duct 43 and a horizontal intake duct 44 that are represented in FIG. 6, etc. The air having passed through the heat sources whose temperature thus has increased is discharged from each of the heat sources, passes through the vertical discharge duct 50 and the horizontal discharge duct 51, and is the discharged to the outside of the copier 10 via the air outlet 53.

When the air inlet and the air outlet are arranged on the side surface that is the laterally outermost side of the image forming device, in order to prevent the air suction efficiency and the air discharge efficiency from lowering, storages, furniture and electronic devices cannot be set in the vicinity of the outer side of the side surface exterior cover. When the air inlet and the air outlet are arranged on the outermost back surface of the image forming device in the anteroposterior direction, it is not possible to set the image forming device with its back surface being in the vicinity of a wall or set storages, furniture and electronic devices in the vicinity of the back surface of the image forming device.

In the copier 10, the front-side air inlet 42 and the air outlet 53 are provided in the front surface of the copier 10. Thus, as illustrated in FIGS. 11 and 12, it is possible to set the first cabinet 301 and the second cabinet 302 as being in the vicinity of or contacting both the right and left surfaces of the copier 10. Furthermore, the copier 10 can be set with its back surface being in the vicinity of or contacting a wall 401.

The front-side air inlet 42 and the air outlet 53 are obtained by providing louvers on the jamming-processor front cover 31 and the front lower exterior cover 35 that serve as exterior covers.

The copier 10 has a height of 1100 mm and, if an air outlet is provided on the top surface of the copier 10 and air is discharged, there is a risk that the air may be discharged to a position close to the face of a user and this may cause discomfort to the user.

On the other hand, in the copier 10 of the embodiment, the air that is used for cooling and whose temperature thus increases and that reaches an upper area in the device is guided by the vertical discharge duct 50 to a lower area in the device and is discharged from the air outlet 53 of the jamming-processor front cover 31 close to the surface of the floor. Accordingly, the air is discharged around the foot of the user and this enables prevention of the air from being discharged to a position close to the face of the user and enables improvement of comfortability to the user.

As a configuration to discharge air from a lower position in the copier 10, a configuration in which an air outlet is provided in the bottom-surface frame 106 and air that is guided by the vertical discharge duct 50 to a lower part in the device is discharged to the floor surface from the air outlet that is provided in the bottom-surface frame 106 can be considered; however, the space between the bottom-surface frame 106 and the floor surface is narrow and there is a risk that discharging the air to the space may lower the air discharge efficiency and thus lower the performance of cooling by the air flow. The configuration in which the air in the space between the bottom-surface frame 106 and the floor surface is sucked from the bottom-surface-frame opening 48 and used for cooling as in the copier 10 of the embodiment has a risk that the discharged air may return into the copier 10 from the bottom-surface-frame opening 48 and thus the cooling performance may lower.

On the other hand, in the copier 10 of the embodiment, the air that is guided to the lower part in the device by the vertical discharge duct 50 is guided by the horizontal discharge duct 51 to the front-side (front) end of the copier 10 and is discharged to the open space from the air outlet 53 that is provided in the front surface of the copier 10. This makes it possible to inhibit the air discharge efficiency from lowering and maintain the performance of cooling using the air flow.

Arranging the air outlet 53 in the vicinity of a lower end of the jamming processor front cover 31 and arranging the front-side air inlet 42 on the front lower exterior cover 35 make the air outlet 53 and the front-side air inlet 42 less outstanding and thus enables aesthetic improvement of the copier 10.

In a conventional image forming device including a discharge duct that extends in the top-down direction, in general, the discharge duct is arranged on the inner side in the left-right direction with respect to the longitudinal conveyance sheet conveyance path as in the image forming device described in Japanese Unexamined Patent Application Publication No. 2005-17881. In the configuration including such a discharge duct, the length of the discharge duct is added in addition to the length in the anteroposterior direction of the device corresponding to arrangement of various members necessary to form an image on a sheet with a maximum width on, for example, the back side of the image forming device and thus the length (depth) of the image forming device in the anteroposterior direction increases. When such an image forming device is arranged along a wall together with office cabinets in which documents, etc., are stored, the depth of the image forming device is sufficiently longer than the cabinets. For this reason, as in the exemplary setting of the exemplary conventional device 110 illustrated in FIG. 33, the image forming device is in a setting state where the image forming device protrudes to the front side. In such a setting state, the exterior of the image forming evince and the exterior of cabinets are not tidy and this causes aesthetic loss in the setting state.

The copier 10 includes the vertical discharge duct 50 that is a discharge path that guides the air to be discharged from the printer unit 20 to the outside of the device. The paper width direction that is a sheet width direction orthogonal to the direction in which the transfer paper P is conveyed in the fed-paper conveyance path 17 and the inversion conveyance path 18 is the anteroposterior direction of the device body of the copier 10. The vertical discharge duct 50 is provided outside the printer unit 20 in the left-right direction of the copier 10 where the paper width direction is the anteroposterior direction. It is thus possible to shorten the depth of the copier 10 compared to the configuration in which the discharge path is arranged outside the image forming unit in the anteroposterior direction.

Shortening the depth of the copier 10 enables, when the first cabinet 301, the second cabinet 302 and the copier 10 are arranged along the wall 401 as illustrated in FIGS. 11 and 12, their front ends to be aligned. Alignment of the front-side ends enables tidy appearance of the copier 10, the first cabinet 301 and the second cabinet 302 and thus enables aesthetic improvement of the setting state.

In the copier 10, the upper electronic unit 60 that houses electronic parts, such as electronic boards, is arranged above the printer unit 20. The electronic parts include a motor that drives the image forming unit and electronic parts that are arranged near the motor to control driving the motor. The electronic parts are arranged in the electronic unit on the back side of the printer unit 20 in order to transmit drive to the parts to be driven, such as various rollers that the image forming unit includes. On the other hand, electronic parts, such as control boards including a central processing unit (CPU), other than the above-described electronic parts that are able to implement functions without being arranged on the back side of the printer unit 20 are arranged in the upper electronic unit 60 that is arranged above the printer unit 20.

The configuration in which electronic parts are arranged in a separate manner enables a shorter depth of the copier 10 than that in the configuration in which most of the electronic parts including control boards are collectively arranged on the back side of the printer unit 20 and thus enables space saving. Furthermore, realizing a shorter depth of the copier 10 than that of conventional copiers and aligning the depths of the copier 10 with the depths of the cabinets (301 and 302) enables aesthetic improvement of the setting state.

The copier 10 has a shorter depth than that of the conventional image forming device and it is possible to arrange the copier 10 with its back surface being close to or contacting the wall 401. Arranging the copier 10 with its back surface being close to or contacting the wall 401 makes it possible to shorten the length of the space occupied by the copier 10 from the wall 401 to the front side end of the copier 10 and save the space in which the copier 10 is set.

In the exemplary setting illustrated in FIGS. 11 and 12, the back surface of the copier 10 contacts the wall 401, the left side surface contacts the first cabinet 301 and the right side surface contacts the second cabinet 302. On the other hand, nothing is set in the area necessary to open and close the image-forming-unit front cover 21 and the jamming-processor front cover 31 on the front side of the copier 10 and the opening of the body internal paper ejection unit 14 is set in the front surface of the copier 10. Thus, even when the copier 10 is arranged with its back surface and both side surface being close to or contacting the wall and cabinets, the user is able to take the transfer paper P that is output to the body internal paper ejection unit 14.

As illustrated in FIGS. 11 and 12, in the embodiment, the copier 10 and the cabinets (301 and 302) whose depths ("W" in FIG. 12) match form an image forming system 200. This enables tidy appearance of the copier 10 and the cabinets that are arranged on both sides of the copier 10 and thus enables aesthetic improvement of the setting state.

Enabling a short anteroposterior length of the copier 10 enables a short anteroposterior shorter length of the cabinets (301 and 302) that match the copier 10 in depth and thus enables overall size reduction of the image forming system 200.

What arranged on the sides of the copier 10 and forming the image forming system 200 is not limited to cabinets. Furniture, such as a desk, other than cabinets and an electronic device, such as a shredder, may be incorporated in the image forming system 200.

In the embodiment, the depth "W" is 45 cm; however the depth is not limited thereto.

Figure 13:
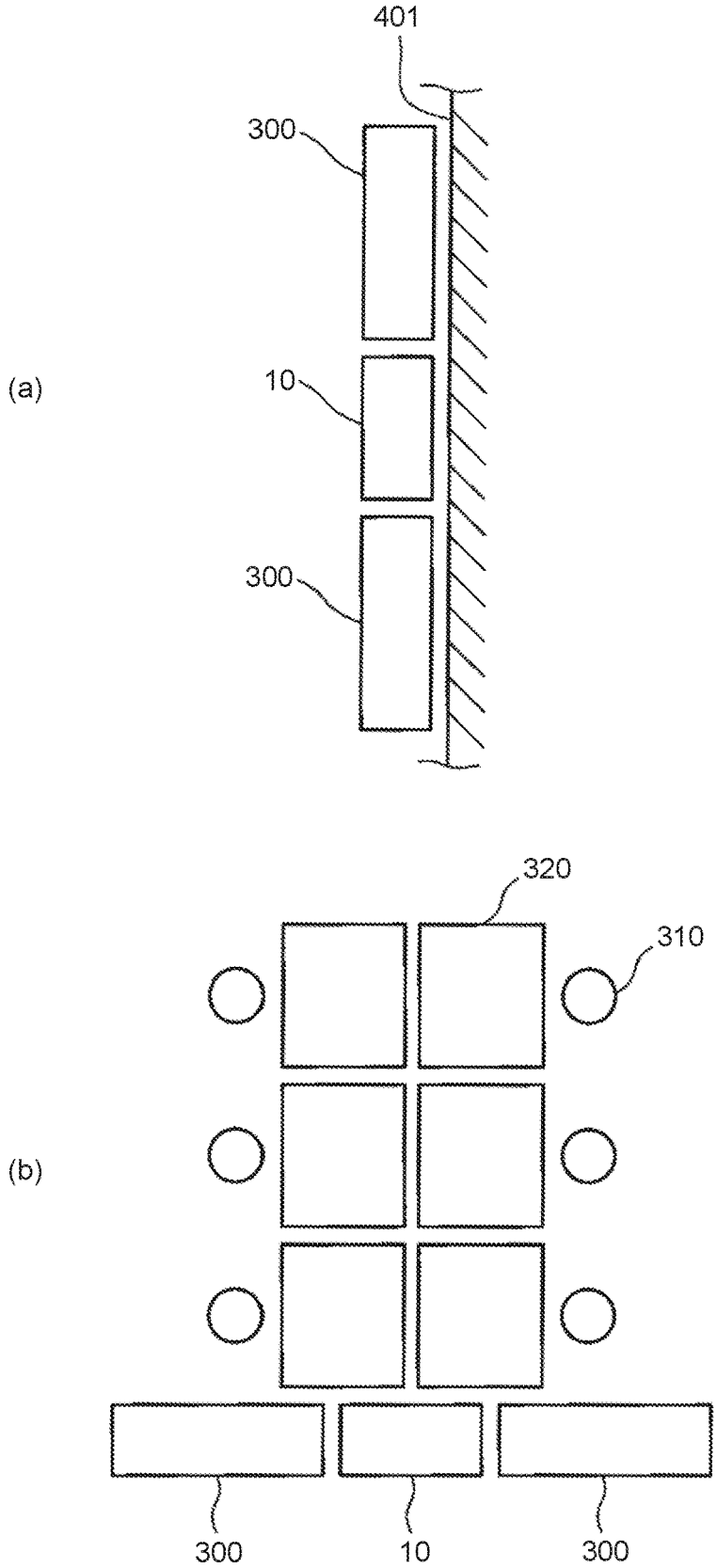
FIG. 13 includes top views of the copier, illustrating exemplary setting of the copier.

FIG. 13 includes top views of the copier 10, illustrating exemplary setting of the copier 10. A section (a) of FIG. 13 is a top view illustrating exemplary setting illustrated in FIGS. 11 and 12 and a section (b) of FIG. 13 is a top view illustrating exemplary setting where the copier 10 is arranged in the vicinity of desks 320 and chairs 310 in a room (office) to perform office work.

As illustrated in FIGS. 11, 12 and the section (a) of FIG. 13, the copier 10 of the embodiment can be built in a cabinet space in which the cabinets 300 are arranged in a building.

The above-described arrangement of the front-side air inlet 42 and the air outlet 53 and the configuration in which the jamming process space 30 is provided in the casing 100 enable arrangement of the copier 10 as contacting with or being in the vicinity of the wall. Because of the built-in in the cabinet space, it is unnecessary to secure a setting space dedicated to OA devices in which an image forming device, such as the copier 10, is arranged.

A configuration to cool a discharge mechanism and the discharge duct enables inhibition of noises, which will be described below, odor and solid particles that occur in the copier 10 from being discharged and thus, even when the copier 10 is set in the vicinity of desks (the desks 320) in the office, inhibits discomfort from being given to the users of the desks. Thus, as illustrated in FIG. 13(*b*), it is possible to set the copier 10 adjacently to the cabinets 300 in the vicinity of the desks (the desks 320) in the office.

The discharge duct will be described.

Figure 14:
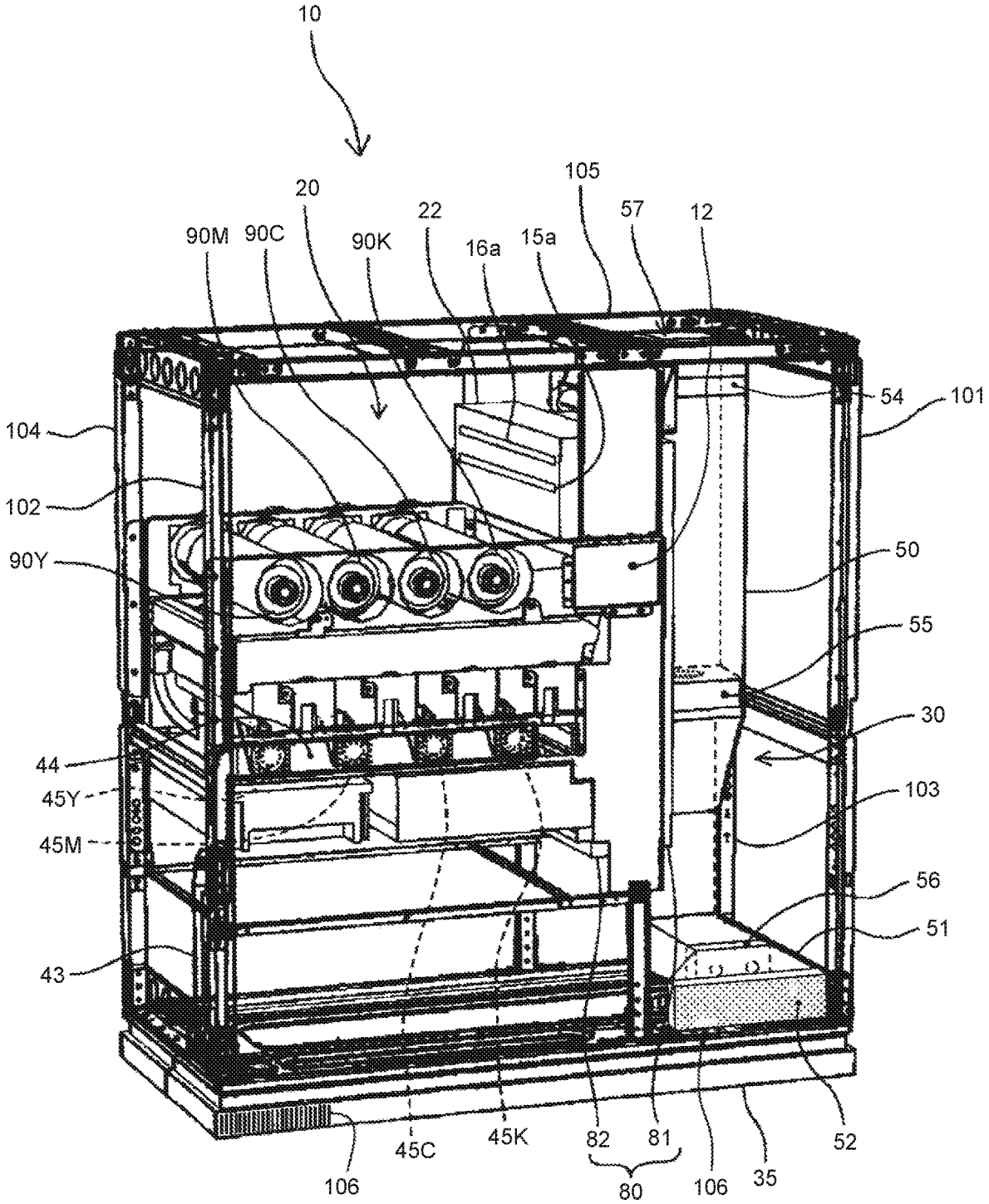
FIG. 14 is a perspective view of the copier viewed from the front left side with its exterior covers, etc., being detached.
Figure 15:
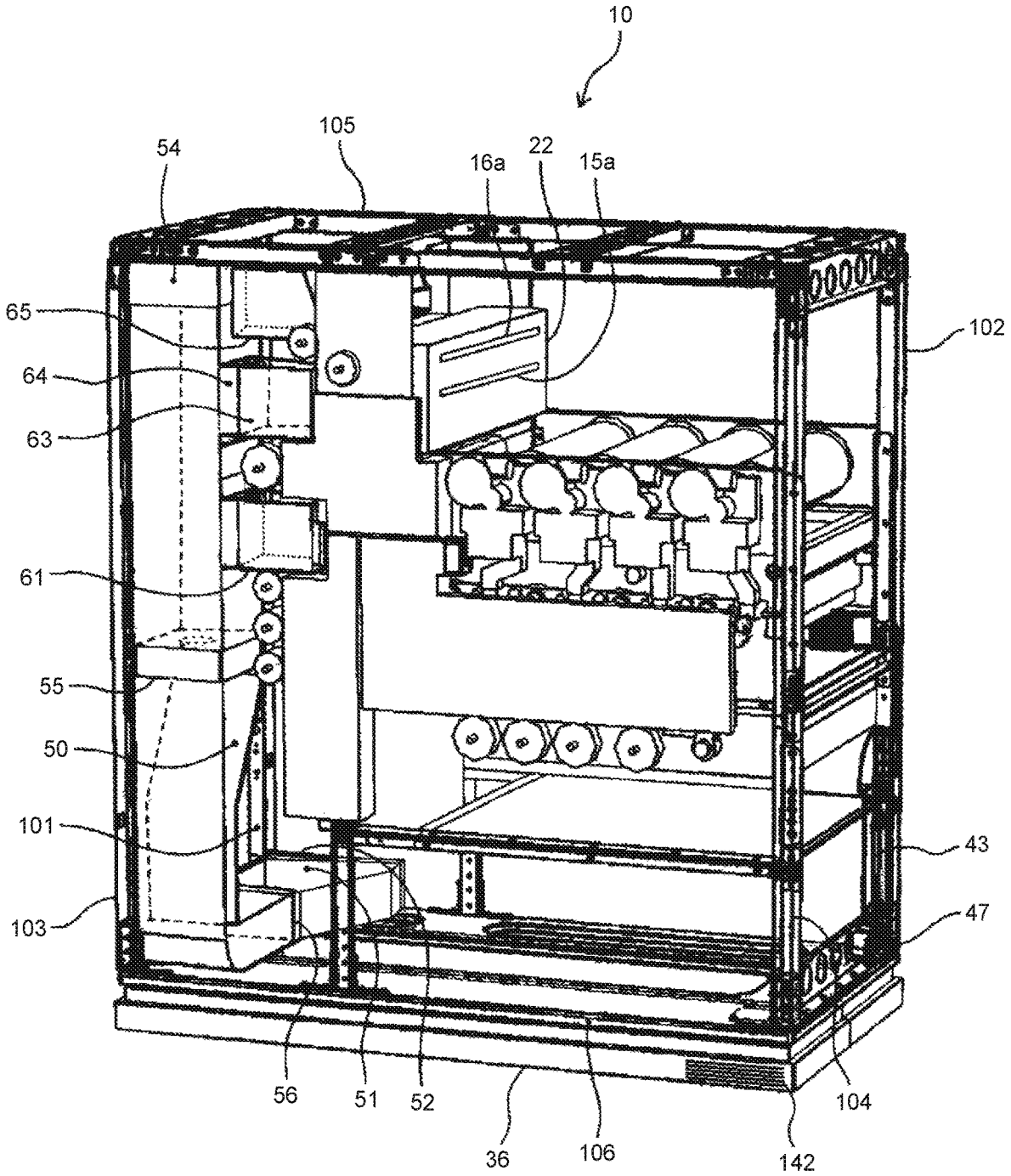
FIG. 15 is a perspective view of the copier illustrated in FIG. 14, viewed from the back left side.
Figure 16:
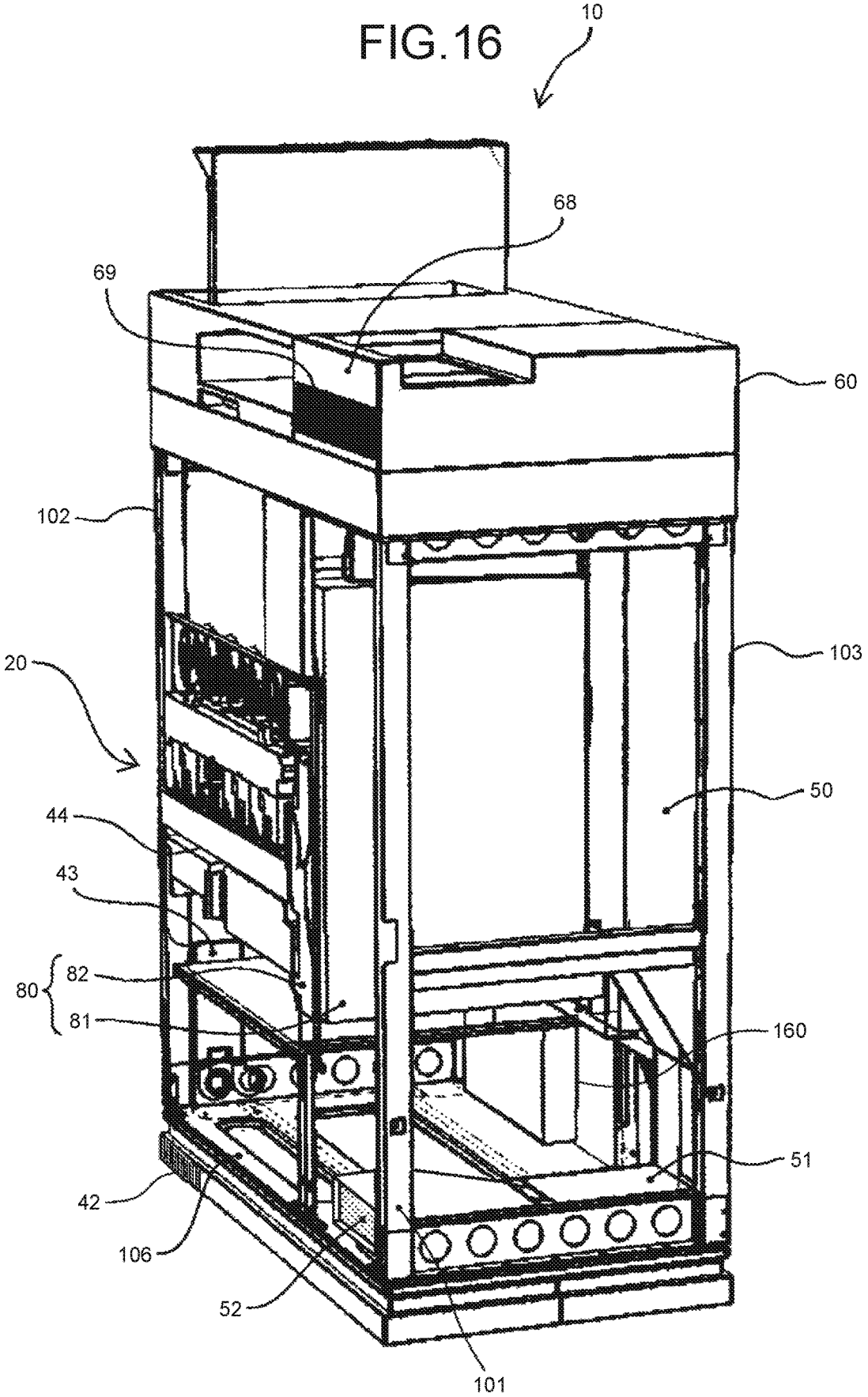
FIG. 16 is a perspective view of the copier viewed obliquely from the right side with its exterior covers being detached.

FIG. 14 is a perspective view of the copier 10 viewed from the front left side with its scanner unit 40, upper electronic unit 60, and exterior covers being detached and FIG. 15 is a perspective view of the copier 10 illustrated in FIG. 14, viewed from the back left side. FIG. 16 is a perspective view of the copier 10 with its exterior covers being detached, viewed from the right side obliquely and FIG. 1 is a schematic cross-sectional view of the copier 10 where the position serving as the center of the vertical discharge duct 50 in the left-right direction is viewed from the right side of the device.

In FIGS. 14 and 15, as for discharge fans (54, 55, 56 and 64) that are arranged in the discharge ducts (50, 51, 61, 63 and 65), lines representing the outer shapes on the front side in each drawing is represented in a solid line for convenience.

As illustrated in FIGS. 14, 15 and 1, the vertical discharge duct 50 that is arranged as extending in the top-down direction from the top to the bottom of the copier 10 includes a first discharge fan 54 and a second discharge fan 55. Arranging at least one discharge fan in a given positon in the vertical discharge duct 50 increases the air discharge efficiency and increases the performance of cooling the inside of the copier 10 by discharging air.

As illustrated in FIGS. 4, 14, 15, 1, etc., the horizontal discharge duct 51 that is arranged as extending horizontally from the back side of the copier 10 to the front side includes a third discharge fan 56. Arranging at least one discharge fan in a given position in the horizontal discharge duct 51 increases the air discharge efficiency and increases the performance of cooling the inside of the copier 10 by discharging air.

As illustrated in FIGS. 3, 14, 15 and 1, the discharge filter 52 is provided at the end of the horizontal discharge duct 51 on the front side of the device and the discharge filter 52 is configured as replaceable. Arranging at least the single discharge filter 52 in a given position on the horizontal discharge duct 51 make it possible to, when solid particles are contained in the air to be discharged, capture the solid particles with the discharge filter 52 and inhibit the solid particles from scattering to the outside of the copier 10. Furthermore, configuring the discharge filter 52 as replaceable makes it possible to replace the discharge filter 52 after the use of the discharge filter 52 for a given time to maintain over time ventilation of the discharge filter 52 and ability of the discharge filter 52 to capture solid particles.

As illustrated in FIGS. 5, 14 and 15, a paper ejection unit 22 is arranged above the fixing device 12. The paper ejection unit 22 includes a paper ejection roller pair 15 and an inversion roller pair 16 and furthermore part of the fed-paper conveyance path 17 and the inversion conveyance path 18 is provided.

As illustrated in FIG. 15, the copier 10 includes a paper-ejection-unit discharge duct 65 above the paper ejection unit 22. The paper-ejection-unit discharge duct 65 guides air in the body internal paper ejection unit 14 to the vertical discharge duct 50.

In the copier 10, the air in the body internal paper ejection unit 14 is guided by the paper-ejection-unit discharge duct 65 to the vertical discharge duct 50 and is discharged from the air outlet 53 to the outside via the vertical discharge duct 50 and the horizontal discharge duct 51.

The air whose temperature is increased by heat applied by the fixing device 12 reaches the body internal paper ejection unit 14 and the transfer paper P that is heated by the fixing device 12 is ejected to the body internal paper ejection unit 14, which accordingly increases the temperature of the air in the body internal paper ejection unit 14. There is a risk that an increase of the temperature in the body internal paper ejection unit 14 may cause discomfort to the user who takes the transfer paper P that is output to the body internal paper ejection unit 14.

The configuration in which the paper-ejection-unit discharge duct 65 that guides air in the body internal paper ejection unit 14 to the vertical discharge duct 50 is provided to discharge the air from the air outlet 53 via the vertical discharge duct 50 and the horizontal discharge duct 51 as in the copier 10 makes it possible to inhibit the temperature in the body internal paper ejection unit 14 from increasing. This enables improvement of comfort to the user.

As illustrated in FIG. 15, the copier 10 includes the image-forming-unit discharge duct 61 that guides the air having passed through the vicinity of the process cartridges 1 of the respective colors to the vertical discharge duct 50.

As illustrated in FIG. 15, the copier 10 further includes the fixing-unit discharge duct 63 that guides the air having passed through the fixing device 12 to the vertical discharge duct 50; and the fixing-unit discharge fan 64 that sucks the air in the fixing device 12 via the fixing-unit discharge duct 63.

As illustrated in FIGS. 16 and 1, the upper electronic unit 60 is set in an upper part of the copier 10 and includes an upper-electronic-unit air inlet 69, through which air to cool the upper electronic unit 60 is sucked, in an upper-electronic-unit exterior cover 68 that is a front exterior cover in the upper part of the copier 10. As illustrated in FIGS. 14 and 1, the top end of the vertical discharge duct 50 serves as a duct opening 57 that is open upward.

The arrows in FIG. 1 represent a schematic path in which the air sucked from the upper-electronic-unit air inlet 69 is discharged from the air outlet 53 as discharged air.

The first discharge fan 54 and the second discharge fan 55 are driven to cause the duct opening 57 to have a negative pressure to suck air in the upper electronic unit 60 that is arranged above the duct opening 57. The suction of the air causes an air flow that is a flow of the air passing through the upper electronic unit 60 from the upper-electronic-unit air inlet 69 to the vertical discharge duct 50 and thus the air sucked from the upper-electronic-unit air inlet 69 can cool the upper electronic unit 60. Discharging the air to be discharged whose temperature has increased in the upper electronic unit 60 that is arranged in the upper part of the copier 10 from the vicinity of the upper electronic unit 60 to the outside has a risk that the air may be discharged to a position close to the face of the user and this may cause discomfort to the user.

The copier 10 has a configuration in which the air to be discharged whose temperature has increased in the upper electronic unit 60 is guided downward by the vertical discharge duct 50 and is discharged from the air outlet 53 that is arranged in a lower position in the device via the horizontal discharge duct 51. Accordingly, it is possible to prevent the air whose temperature has increased in the upper electronic unit 60 from being discharged to a position close to the face of the user and thus improve the comfort to the user.

A configuration to suck the external air from the front-side air inlet 42 will be described.

Figure 17:
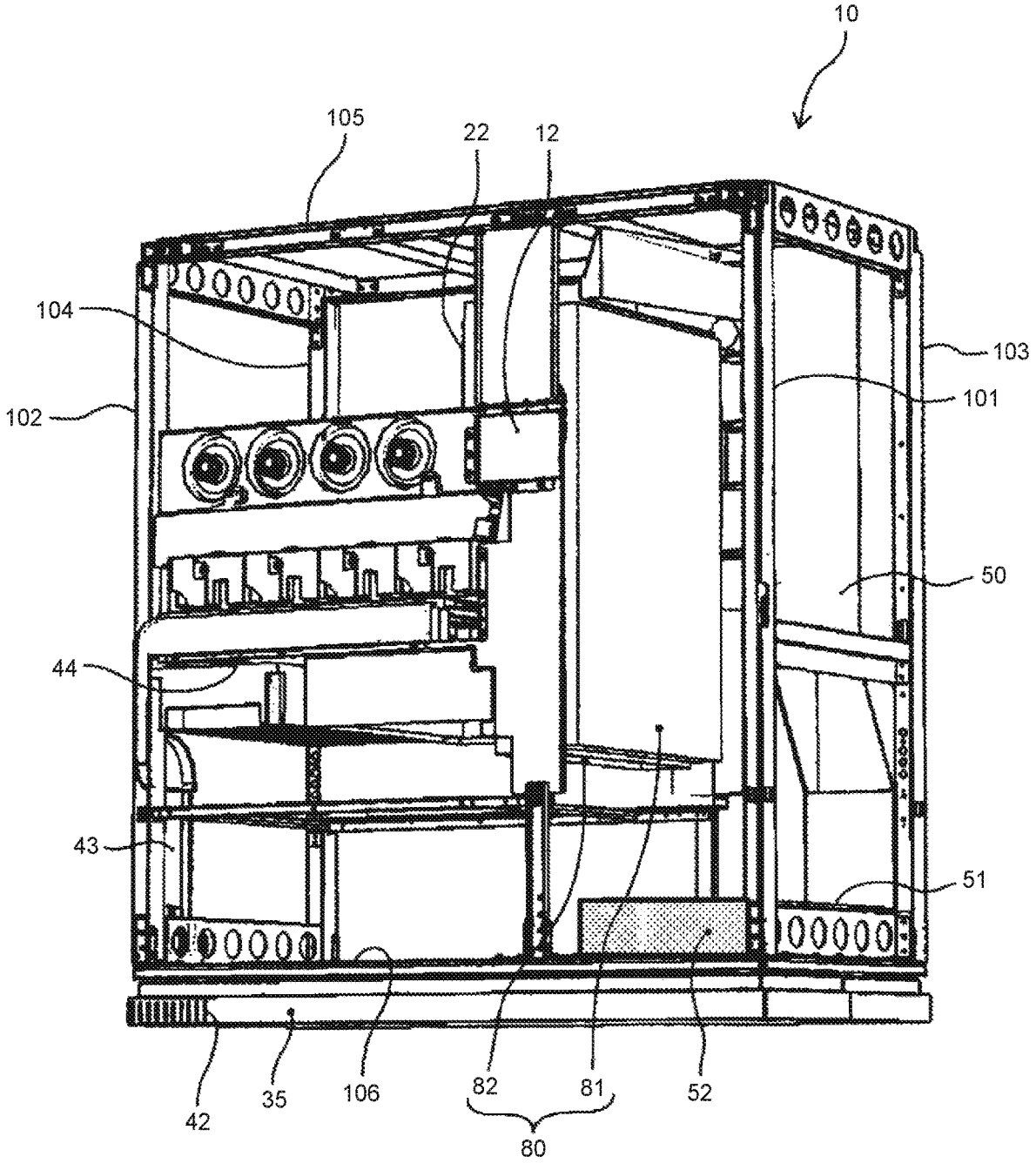
FIG. 17 is a perspective view of the copier viewed from a slightly lower side of the front right side with its exterior cover being detached.

FIG. 17 is a perspective view of the copier 10 viewed from a slightly lower side of the front right side with its scanner unit 40, upper electronic unit 60 and exterior cover being detached. FIG. 18 is a perspective view of a lower part of the copier 10 illustrated in FIG. 17 viewed from a slightly upper side of the front right side.

Figure 18:
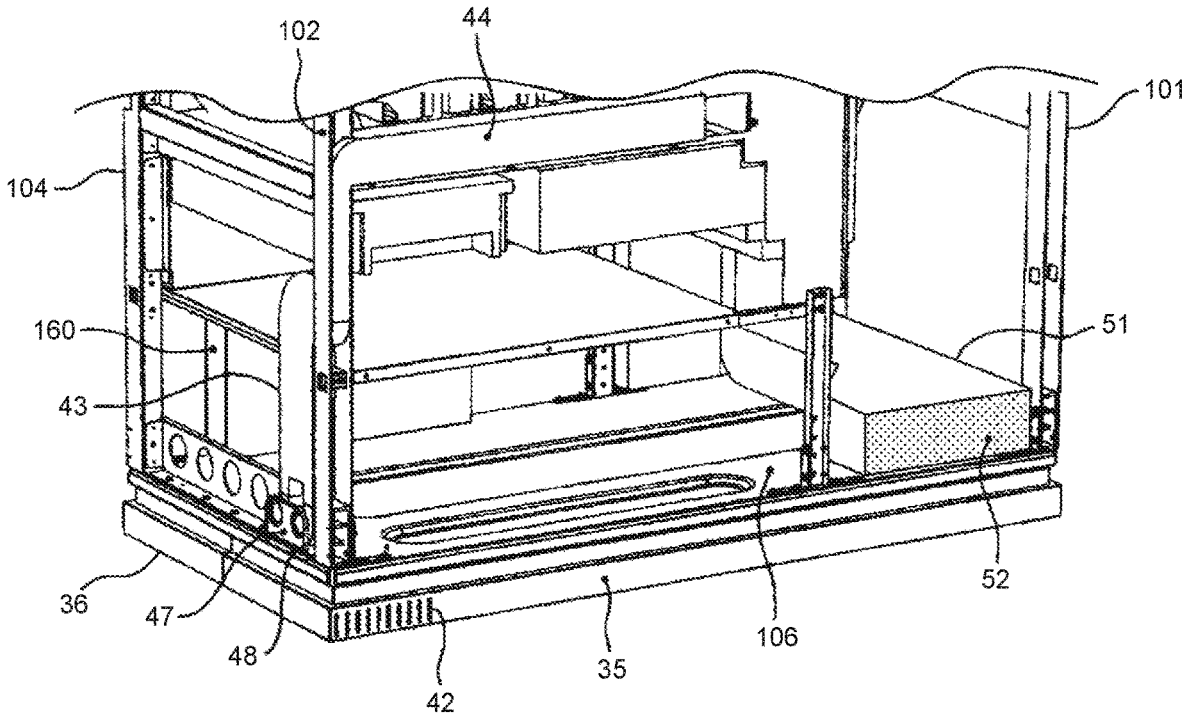
FIG. 18 is a perspective view of a lower part of the copier illustrated in FIG. 17, viewed from the slightly upper side on the front left side.

As illustrated in FIGS. 17 and 18, the copier 10 includes the vertical intake duct 43 that guides the air sucked from the front-side air inlet 42 upward. As illustrated in FIG. 18, the copier 10 further includes the suction fan 47 in a lower end of the vertical intake duct 43. The suction fan 47 sucks air in the space between the bottom surface frame 106 and the floor surface via the bottom-surface-frame opening 48.

Figure 19:
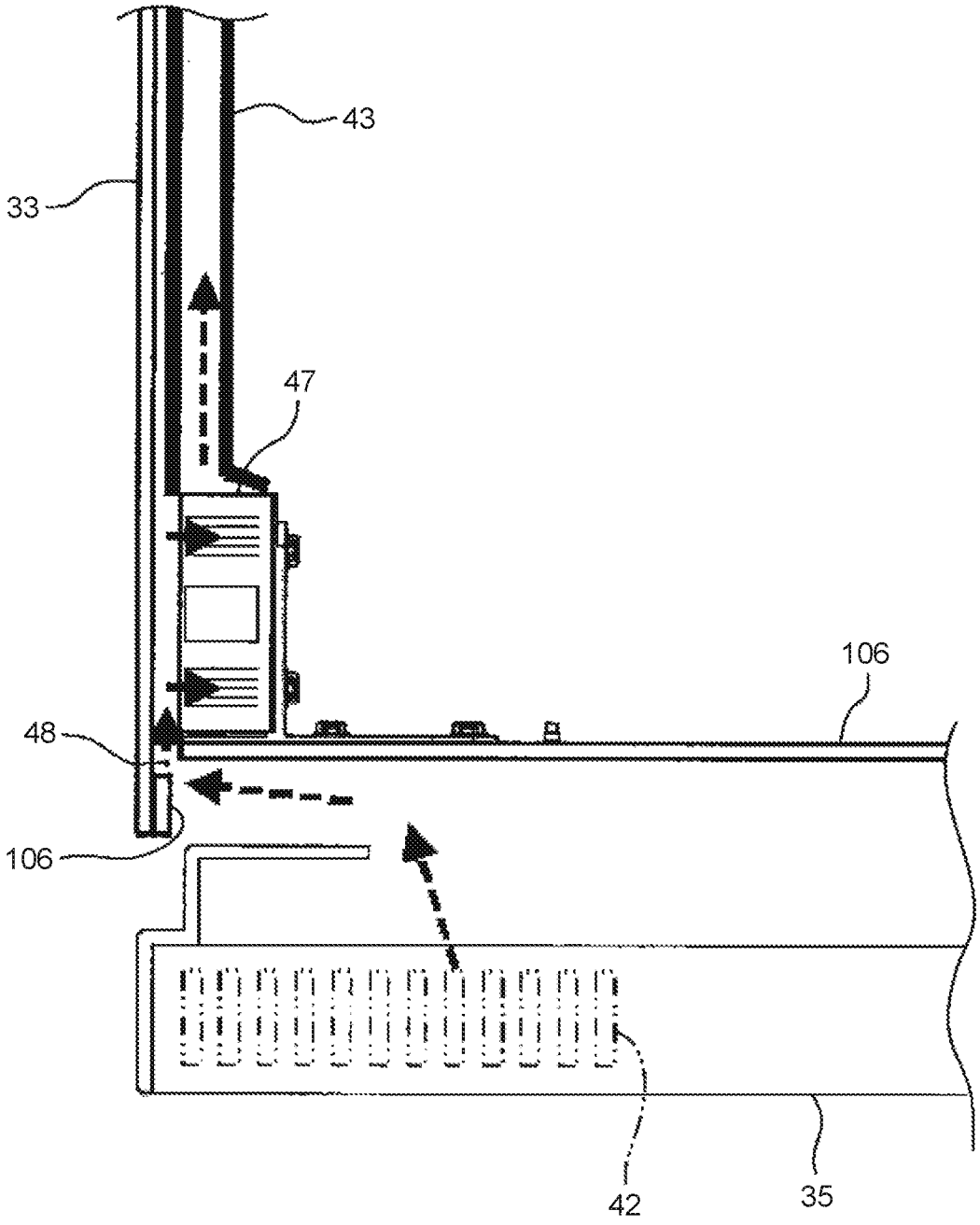
FIG. 19 is an enlarged cross-sectional view of the vicinity of a suction fan viewed from the front side of the copier.

FIG. 19 is an enlarged cross-sectional view of the vicinity of the suction fan 47 viewed from the front side of the copier 10. In FIG. 19, the front lower exterior cover 35 positioned on the front side with respect to the suction fan 47 is represented in a solid line for convenience and the front-side air inlet 42 is represented by chain double-dashed lines. The dotted arrows in FIG. 19 represent the flow of air sucked from the front-side air inlet 42.

As illustrated in FIGS. 18 and 19, the copier 10 includes a bottom-surface-frame opening 48 on the front side on the left-side end of the bottom-surface frame 106. The bottom-surface-frame opening 48 allows communication between the clearance that is formed between the suction fan 47 and the left-surface exterior cover 33 and the space between the bottom-surface frame 106 and the floor surface.

When the suction fan 47 is driven, air outside the copier 10 passes through the front-side air inlet 42 and is guided to the space between the bottom-surface frame 106 and the floor surface. The suction force of the suction fan 47 causes the air in the space to pass through the bottom-surface-frame opening 48, be guided into the clearance formed between the suction fan 47 and the left-surface exterior cover 33, pass through the suction fan 47 and be guided to the vertical intake duct 43.

The horizontal intake duct 44 is connected to the upper end of the vertical intake duct 43 and the air having reached to the horizontal intake duct 44 is guided to the vicinity of the process cartridges 1 of the respective colors and into the fixing device 12, etc.

As represented by the dotted lines in FIG. 14, the copier 10 has a configuration in which the four image-forming-unit suction fans 45 (Y, M, C and K) are connected to the horizontal intake duct 44 and air is supplied to the cooling ducts that are respectively adjacent to the four process cartridges 1.

It can be assumed that the air inlet through which external air is sucked is provided in the front exterior cover of the copier 10 at the same level as that of the image forming unit, such as the process cartridges 1. When a suction inlet is arranged at the same level as that of the image forming unit, however, the air inlet tends to be prominent and this causes aesthetic deterioration of the copier 10. Furthermore, the noise occurring from the image forming unit tends to be leaked from the air inlet that is provided on the front exterior cover via the air inlet path.

The copier 10 includes the vertical intake duct 43 and the suction fan 47 to suck air under the bottom-surface frame 106 into the copier 10. The bottom-surface-frame opening 48 that is a lower-surface suction inlet through which air in the space under the bottom-surface frame 106 is provided in the bottom-surface frame 106 and the front-side air inlet 42 that is an external suction inlet that guides air outside the copier 10 to the space under the bottom-surface frame 106 is provided in the front lower exterior cover 35.

Provision of the bottom-surface-frame opening 48 that guides the air in the space under the bottom-surface frame 106 into the copier 10 in the bottom-surface frame 106 makes the bottom-surface-frame opening 48 unviewable from outside and accordingly enables aesthetic improvement of the copier 10. Furthermore, the front-side air inlet 42 that guides air outside the copier 10 into the space under the bottom-surface frame 106 is provided in the front lower exterior cover 35 that is arranged in the lower end of the copier 10. As the front-side air inlet 42 is in the lower part of the copier 10 where the front-side air inlet 42 is less noticeable, aesthetic improvement of the copier 10 can be made.

In the embodiment, air sucked from the front-side air inlet 42 in the front lower exterior cover 35 passes through a complicated suction path including the bottom-surface-frame opening 48 in the bottom-surface frame 106, the clearance between the suction fan 47 and the left-surface exterior cover 33, the vertical intake duct 43 and the horizontal intake duct 44. As the sound transmitted from the image forming unit via the inlet path sufficiently attenuates until the sound is transmitted to the front-side air inlet 42 via the complicated suction path, the sound generated from the image forming unit can be inhibited from leaking from the front-side air inlet 42 to the outside of the device.

A configuration to cool the vertical discharge duct 50 in the copier 10 will be described.

As illustrated in FIG. 1, the copier 10 is an electronic device that includes the upper electronic unit 60 and the vertical discharge duct 50 that guides air that is heated by heat that is generated by the upper electronic unit 60 to the outside of the device. As illustrated in FIGS. 1 and 7, the back-surface exterior cover 34 includes a cover internal space 350 that is surrounded by a back-surface inner wall 341, a back-surface outer wall 342, a back-surface right wall 343 and a back-surface left wall 344 and that extends vertically. An upper opening 351 and a lower opening 352 in different vertical positions allows the cover internal space 350 to be open to the space outside the device.

As illustrated in FIGS. 1 and 7, the copier 10 includes a heatsink 23 that is a heat conductor including heat absorption fins 231 that are positioned in the vertical discharge duct f50 and heat dissipation fins 232 that are positioned in the cover internal space 350.

Figure 20:
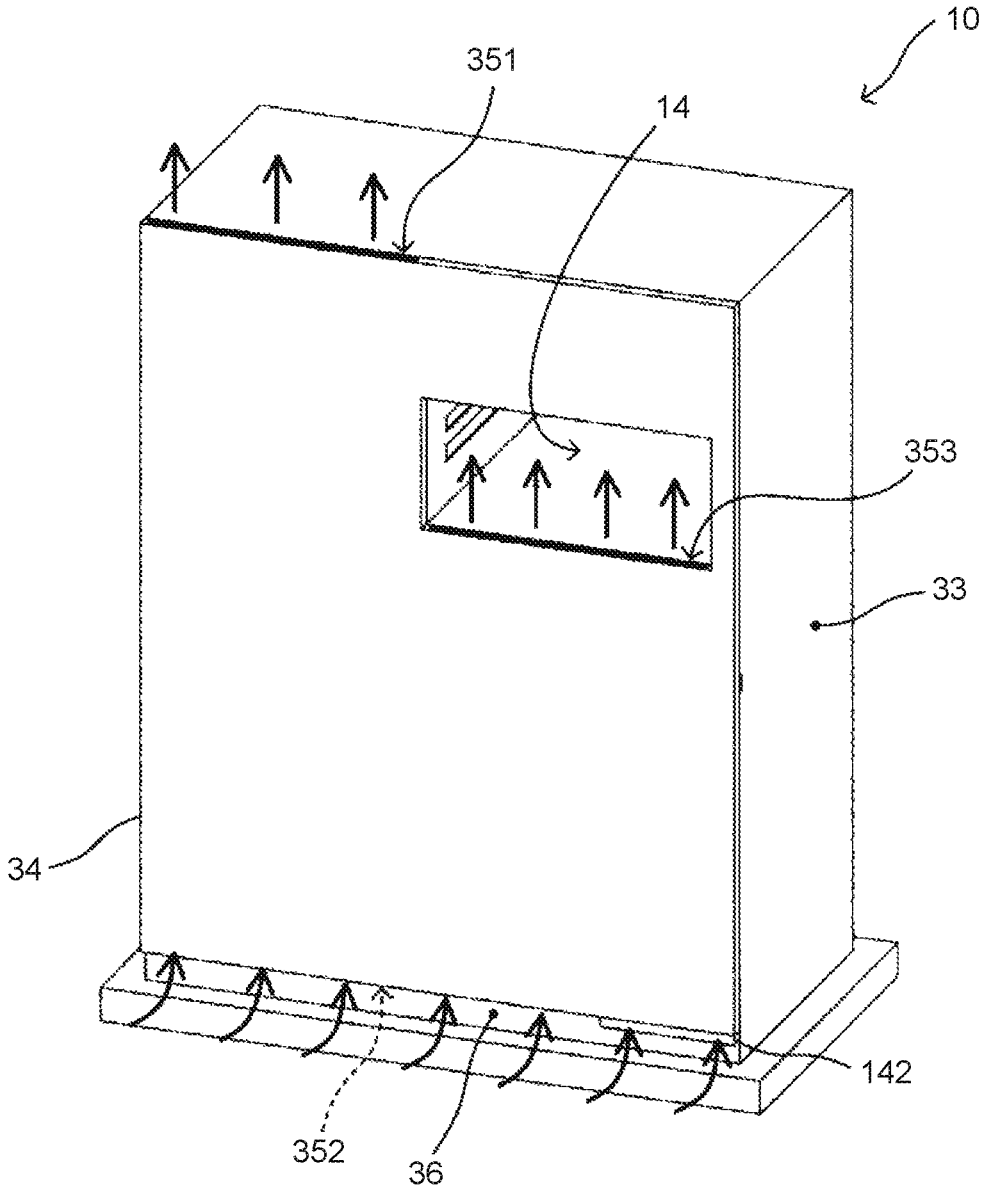
FIG. 20 is a perspective view of the copier viewed from the left back side.

FIG. 20 is a perspective view of the copier 10 viewed from the left back side. As illustrated in FIG. 20, the back-surface exterior cover 34 includes, as openings that allows the cover internal space 350 to be open to the space outside the device, a paper-ejection-side upper opening 353 on the back side of the body internal paper ejection unit 14 in addition to the upper opening 351 and the lower opening 352. The arrows in FIG. 20 represent an air flow in which external air flows into the cover internal space 350 from the lower opening 352 and the air in the cover internal space 350 flows out of the device to the outside from the upper opening 351 and the paper-ejection-side upper opening 353.

Figure 21:
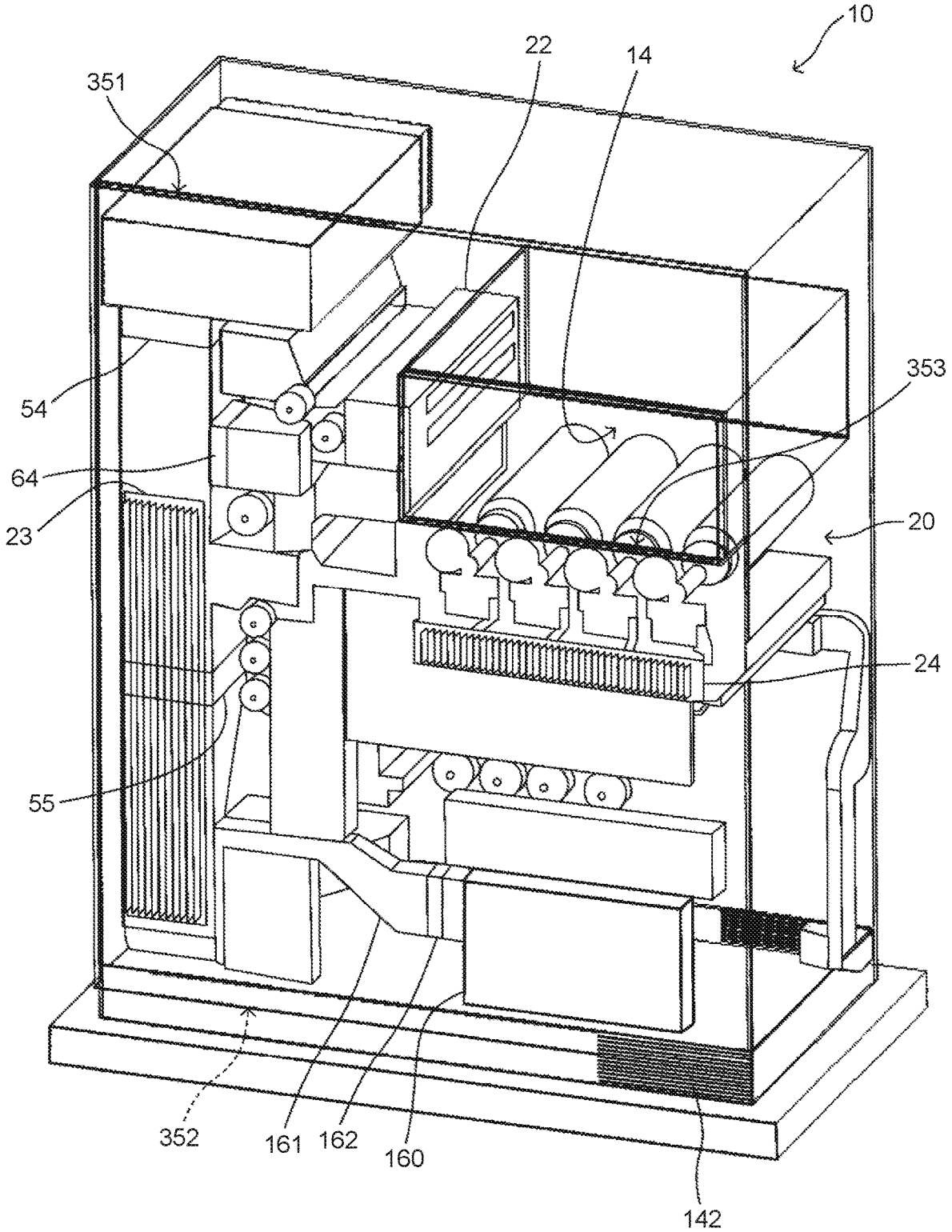
FIG. 21 is a perspective view of the copier viewed in the same direction as that in FIG. 20.

FIG. 21 is a perspective view of the copier 10 viewed in the same direction as that in FIG. 20. FIG. 21 represents the outer shape of the exterior covers in solid lines and represents the printer unit 20, various electronic units, intake ducts, discharge ducts, the heatsink 23, etc., that are positioned on the inner side with respect to the exterior cover. As illustrated in FIG. 15, etc., the copier 10 includes the frames on the inner side with respect to the exterior covers; however, FIG. 21 does not illustrate the frames for convenience.

Figure 22:
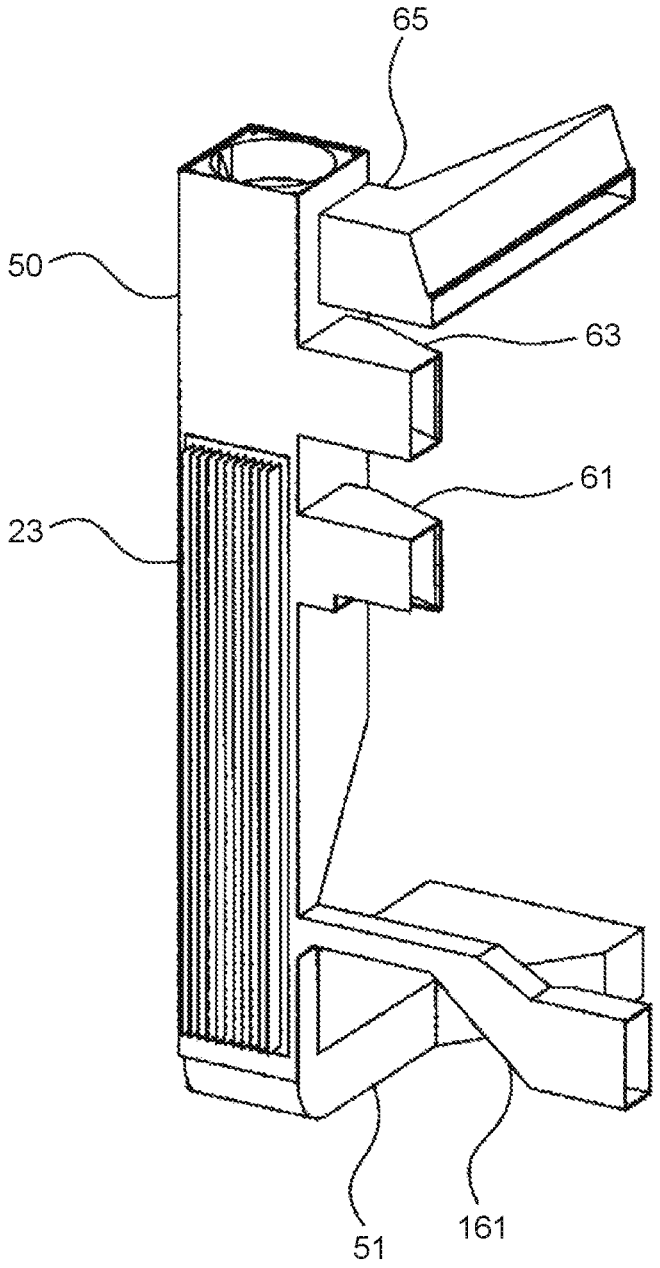
FIG. 22 is a perspective illustration of discharge ducts that the copier includes.

FIG. 22 is a perspective illustration of the discharge ducts that the copier 10 includes.

As illustrated in FIGS. 21 and 22, the copier 10 includes, as ducts that guide the air to be discharged to the vertical discharge duct 50, the image-forming-unit discharge duct 61, the fixing-unit discharge duct 63, the paper-ejection-unit discharge duct 65 and a back-surface lower-electronic-unit discharge duct 161.

As illustrated in FIG. 21, the back-surface lower-electronic-unit discharge duct 161 is connected to a back-surface lower electronic unit 160 and a back-surface lower-electronic-unit discharge fan 162 is arranged in the back-surface lower-electronic-unit discharge duct 161. Driving the back-surface lower-electronic-unit discharge fan 162 causes the air heated in the back-surface lower electronic unit 160 to be guided to the vertical discharge duct 50 via the back-surface lower-electronic-unit discharge duct 161.

As illustrated in FIG. 22, the heatsink 23 is mounted on the back side of the vertical discharge duct 50.

Figure 23:
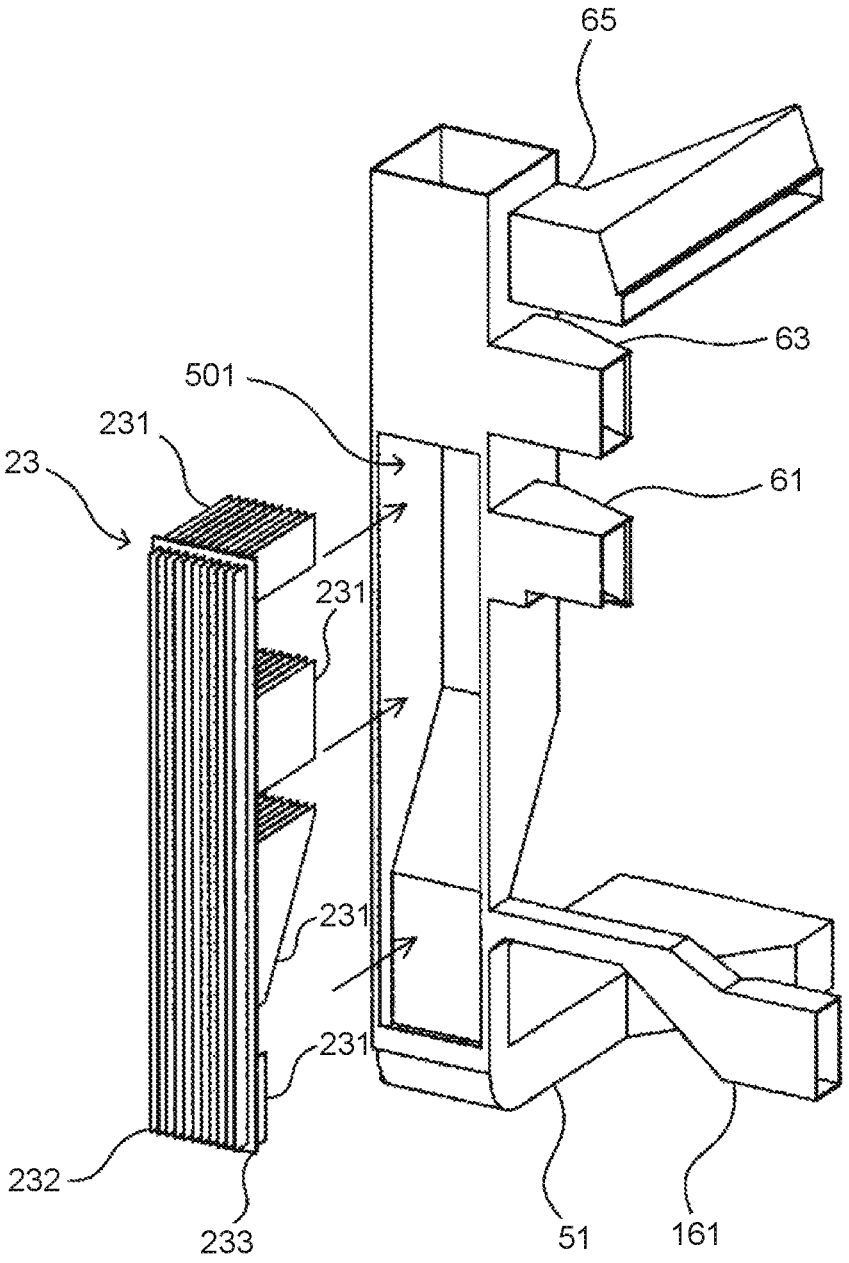
FIG. 23 is a diagram illustrating mounting a heatsink on a vertical discharge duct.

FIG. 23 is a diagram illustrating mounting the heatsink 23 on the vertical discharge duct 50. As illustrated in FIG. 23, the heatsink 23 includes the heat absorption fins 231, the heat dissipation fins 232, and a fin holder board 233. A duct back-surface opening 501 for mounting the heatsink 23 is provided in the back surface of the vertical discharge duct 50 and the heatsink 23 is mounted as occluding the duct back-surface opening 501 with the fin holder board 233.

Figure 24:
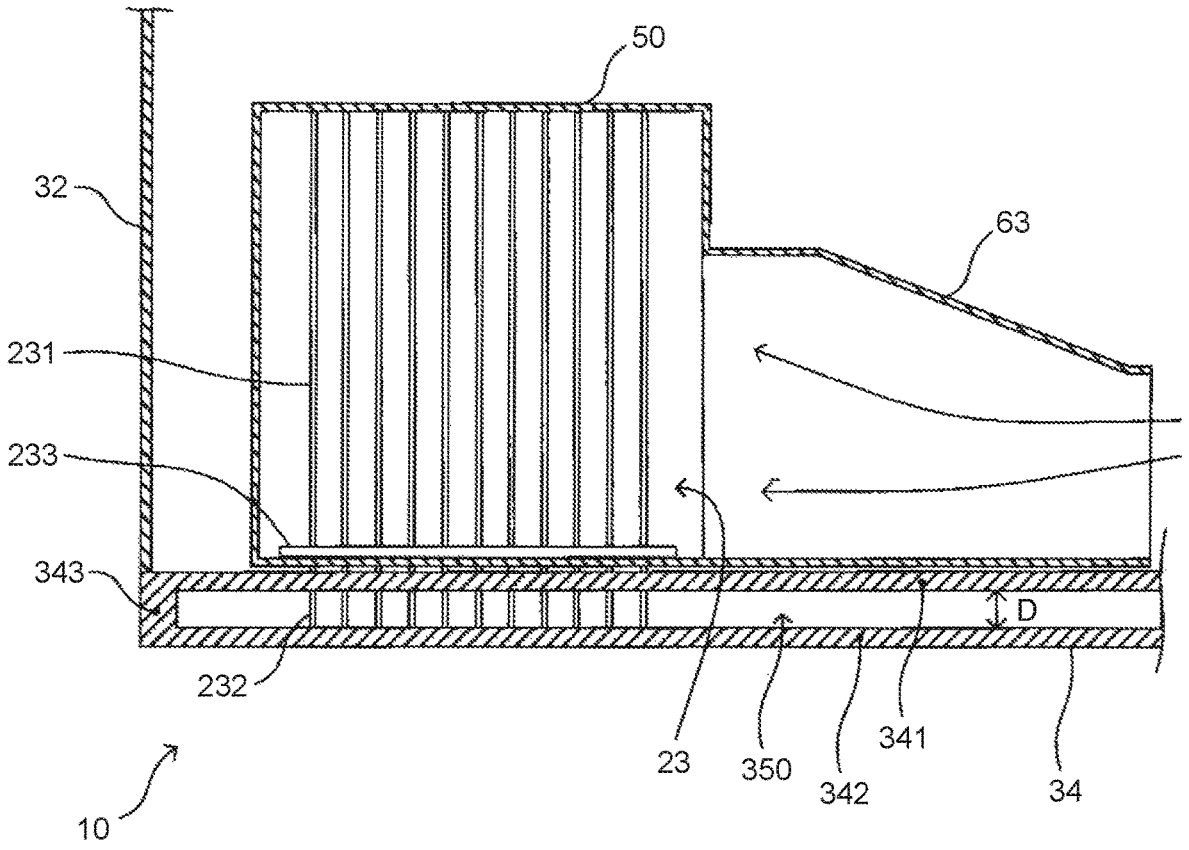
FIG. 24 is a cross-sectional view of the vicinity of the vertical discharge duct in the copier viewed from above.

FIG. 24 is a cross-sectional view of the vicinity of the vertical discharge duct 50 in the copier 10 viewed from above. As in FIG. 21, FIG. 24 does not illustrate the frame (the back-surface right frame 103) for convenience. The arrows in FIG. 24 represent the flow of air that is heated in the device and flows into the vertical discharge duct 50. In the copier 10 of the embodiment, a width D of the cover internal space 350 interposed between the back-surface inner wall 341 and the back-surface outer wall 342 is 20 mm; however, the width is not limited thereto.

As illustrated in FIGS. 1, 7 and 21 to 24, the copier 10 includes the back-surface exterior cover 34 including the back-surface inner wall 341 and the back-surface outer wall 342 as a double-layered exterior cover including an inner cover and an outer cover. The copier 10 further includes the heatsink 23 for causing the heat in the device body, which is surrounded by the exterior covers (21, 31, 32, 33 and 34) of the copier 10 and in which the printer unit 20 is arranged, to move to the outside of the device body. As illustrated in FIGS. 1 to 7, the back-surface inner wall 341 that is the inner cover has the opening allowing the heatsink 23 to protrude from the inside of the device body. The heatsink 23 protrudes from the inside of the device body to the cover internal space 350 inside the back-surface exterior cover 34.

In the copier 10, heat in the vertical discharge duct 50 is absorbed by the heat absorption fins 231 of the heatsink 23 and is dissipated from the heat dissipation fins 232 into the cover internal space 350. The heat dissipation heats the air in the cover internal space 350 to increase the temperature and the heated air lowers in density and thus rises.

The cover internal space 350 is surrounded by the walls and extends vertically and the upper opening 351, the paper-ejection side upper opening 353 and the lower opening 352 allow the cover internal space 350 to be open to the space outside the device.

In the copier 10, the so-called chimney effect causes an air flow in which air outside the device enters the cover internal space 350 from the lower opening 352 and the air passes through the cover internal space 350 and is discharged from the upper opening 351 to the outside of the device.

Specifically, the heat dissipation from the heat dissipation fins 232 increases the temperature of the air in the cover internal space 350 to a temperature higher than that of the external air. As air at a high temperature has a lower density than that of air at a low temperature, the heated air in the cover internal space 350 moves upward and accordingly the pressure in the lower part in the cover internal space 350 becomes lower than that of the external air. The difference in pressure causes external air at a low temperature to be sucked from the lower opening 352 at the lower end of the cover internal space 350 and at the same time the air heated to the high temperature rises in the cover internal space 350 and is ejected from the upper opening 351 or the paper-ejection-side upper opening 353.

As described above, in the cover internal space 350, an airflow in which, while air at a low temperature outside the device is being drawn into the cover internal space 350 from the lower opening 352, air whose temperature has increased to a high temperature because of heat dissipation by the heatsink 23 is discharged from the upper opening 351 occurs.

The airflow enables efficient heat dissipation from the heat dissipation fins 232 and thus enables improvement of the performance of cooling air in the vertical discharge duct 50 by the heatsink 23.

As in the copier 10 of the embodiment, the heat discharge ability of the configuration to discharge heat by discharging air that is heated by the heat sources in the device to the outside via the discharge path that is formed by the vertical discharge duct 50, etc., depends on the temperature and amount of flow of the gas in the discharge path. Furthermore, when the amount of heat generated by the heat sources increases, the heat may be discharged insufficiently and this may hinder sufficient inhibition of the temperature of the device body from increasing.

In order to prevent insufficient heat discharge, increasing heat discharge ability by increasing the amount of flow in a discharge path can be considered; however, in order to increase the flow amount, it is necessary to increase an output of a blowing unit, such as a discharge fan, which leads to an increase in power consumption and noise.

On the other hand, in the copier 10, when the temperature in the discharge path in the vertical discharge duct 50 is higher than the temperature in the cover internal space 350, the heat absorption fins 231 of the heatsink 23 absorb the heat in the discharge path and the heat dissipation fins 232 dissipate the heat in the cover internal space 350. The heat dissipation in the cover internal space 350 heats the air in the cover internal space 350 and the air whose temperature has increased has a small density and thus is light and rises. When the air in the cover internal space 350 that is surrounded by the walls and extends vertically rises, the chimney effect causes an air flow in which air outside the device enters the cover internal space 350 from the lower opening 352, passes through the cover internal space 350 and is discharged to the outside of the device from the upper opening 351.

The airflow keeps replacing the gas in the cover internal space 350 and thus it is possible to prevent the air that is heated by the heat dissipation from the heat dissipation fins 232 from being stagnant around the heat dissipation fins 232 and keep dissipating heat from the heat dissipation fins 232. For this reason, the heat absorption fins 231 of the heatsink are able to keep absorbing the heat in the discharge path and thus lower the temperature of the air in the discharge path. Accordingly, it is possible to increase the heat discharge ability in the copier 10 that discharges heat by discharging heated air to the outside via the discharge path and thus inhibit the temperature in the device from increasing excessively.

Figure 25:
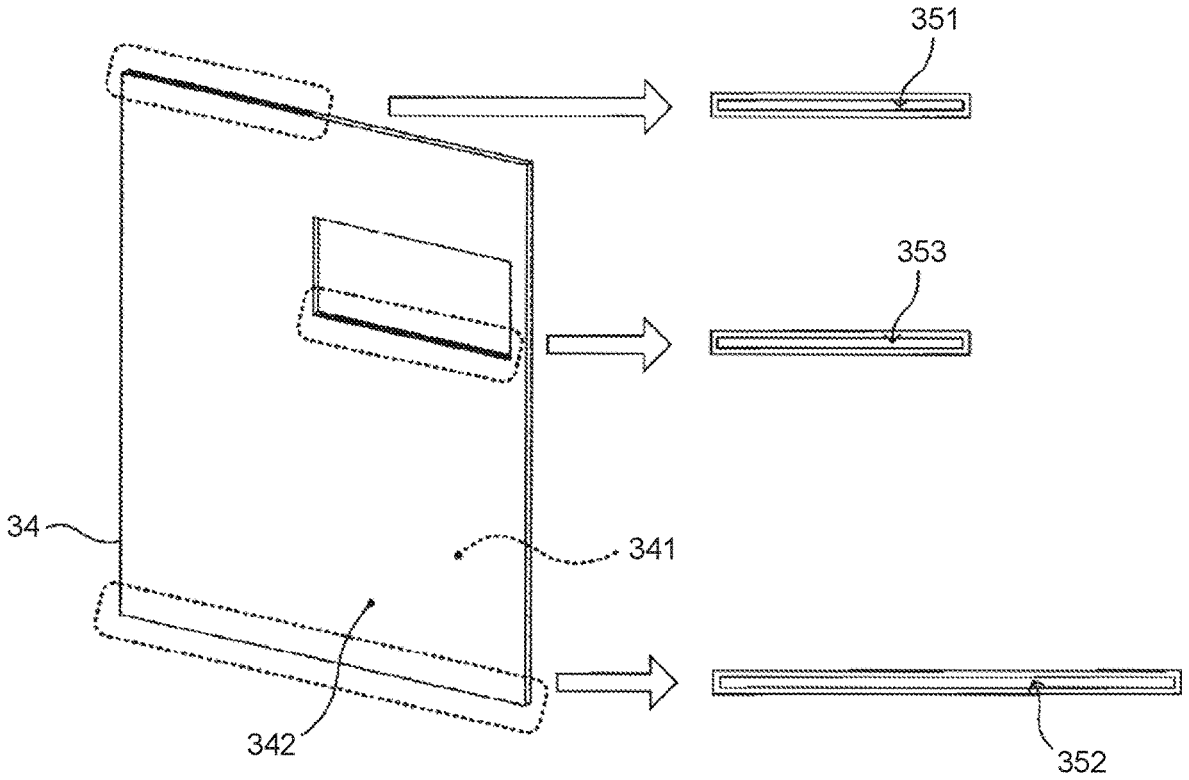
FIG. 25 is an illustration of a back surface exterior cover of the copier.

FIG. 25 is a diagram illustrating the back-surface exterior cover 34 of the copier 10. As illustrated in FIG. 25, the back-surface exterior cover 34 includes the upper opening 351 and the paper-ejection-side upper opening 353 as openings through which the air flow having passed through the cover internal space 350 is ejected. The back-surface exterior cover 34 further includes the lower opening 352 as an opening through which an air flow to pass through the cover internal space 350 is sucked.

As illustrated in FIGS. 21 and 22, etc., in the copier 10, the air outlet 53 to discharge heat to be discharged in the image forming device, such as electronic-unit heat to be discharged, paper-ejection heat to be discharged, fixing heat to be discharged and developing heat to be discharged, together with air to the outside of the device is provided in the lower part of the device body of the copier 10. The copier 10 further includes the back-surface exterior cover 34 that is a double-layered exterior cover adjacent to the vertical discharge duct 50 that guides the air to be discharged to the air outlet 53; and the heatsink 23 that moves the heat in the vertical discharge duct 50 to the cover internal space 350 that is formed by the back-surface exterior cover 34.

As illustrated in FIG. 25, the back-surface exterior cover 34 includes the lower opening 352 in a lower end, which is an opening through which an air flow is sucked, and includes the upper opening 351 and the paper-ejection-side upper opening 353, respectively in the upper end and the part where the body internal paper ejection unit 14 is formed, which are openings through which the airflow is ejected.

The air whose temperature has increased by heat dissipation in the cover internal space 350 inside the back-surface exterior cover 34 rises and the air moves through the cover internal space 350 from the lower end of the back-surface exterior cover 34 to the upper end.

As the copier 10 has no air inlet and air outlet on the left and right side surfaces of the device, it is possible to arrange the copier 10 with its side surfaces being close to or contacting other objects, such as the wall 401 and the cabinets 300, as illustrated in FIG. 13.

The front-side air inlet 42 and the air outlet 53 are provided on the front surface of the copier 10. On the other hand, the back-side air inlet 142 illustrated in FIGS. 15, 20 and 21 is formed by providing louvers on a back-surface lower exterior cover 36 on the back side of the copier 10. The back-side air inlet 142 is arranged on the back-surface lower exterior cover 36 that is on the back side of the copier 10 but on the inner side in the anteroposterior direction with respect to the back-surface outer wall 342 that forms the back surface of the back-surface exterior cover 34. Thus, even when the copier 10 is arranged with its back-surface cover being close to a wall, it is still possible to suck air from the back-side air inlet 142. Such arrangement of the front-side air inlet 42, the air outlet 53 and the back-side air inlet 142 enables arrangement in which the back surface of the body of the copier 10 is close to or contacts other objects, such as the wall 401 and the cabinets 300, as illustrated in FIG. 13.

Furthermore, the air outlet 53 is arranged in the lower part of the front side of the copier 10. Thus, even when the user stands in front of the copier 10 to operate the copier 10, the user does not get the air that is heated by the heat to be discharged (air to be discharged) and toner mixed therein. Furthermore, noise made when the fan motor to cause the discharge fans to rotate may leak from the air outlet 53; however, positioning the air outlet 53 in the lower part of the copier 10 enables inhibition of the noise made when the fan motor is driven from being directly delivered to the ears of the user.

As the upper opening 351 that is the opening through which an airflow is ejected is provided on the upper surface of the copier 10, there is a risk that the airflow may be ejected to a position close to the face of the user; however, as the airflow is not an airflow that is caused by an external mechanical cause, such as a discharge fan, but an air flow occurring because of a difference in temperature of air, the user does not get uncomfortable noise, such as noise of a fan motor, or a powerful flow of discharged heat and thus comfort to the user can be maintained. Furthermore, the temperature of the airflow is lower than that of the air that is discharged after passing through the discharge duct and the ejected air does not pass through the device body and thus does not contain odor and solid particles and accordingly, even when the user gets the airflow, the airflow does not cause discomfort to the user like that caused when the user gets discharged air.

As illustrated in FIGS. 20 and 25, in the back-surface exterior cover 34, the opening is provided in the part corresponding to the body internal paper ejection unit 14. The opening enables the user to access the body internal paper ejection unit 14 from the back side of the copier 10 and collect the transfer paper P to which an image is output not only from the front side of the copier 10 but also from the back side and this increases usability to the user.

As illustrated in, for example, FIG. 1, the air outlet 53 through which the air having passed through the discharge duct (air to be discharged) is discharged is positioned on the front side of the copier 10 and the lower opening 352 that is the opening through which the airflow to pass through the cover internal space 350 of the back-surface exterior cover 34 is sucked is positioned on the back side of the copier 10. The copier 10 has the configuration in which the position in which air heated by the heat sources is discharged and the position in which an airflow to pass through the cover internal space 350 is sucked are separated from each other, which is a configuration that prevents a failure that the air to be discharged whose temperature has increased to a temperature higher than that of the external air flows into the cover internal space 350 and the cooling effect thus lowers. The configuration also enables prevention of the user from getting discharged air via the cover internal space 350.

As illustrated in FIG. 24, the back side ends of the heat dissipation fins 232 preferably contact the inner wall surface of the back-surface outer wall 342. Accordingly, it is possible to realize a configuration that not only enables heat transmitted to the heat dissipation fins 232 to be dissipated to the air in the cover internal space 350 but also enables the heat to be transmitted from the heat dissipation fins 232 to the back-surface outer wall 342 not via air and to be dissipated from the outer wall surface of the back-surface outer wall 342 to the external air. The configuration enables improvement of the performance of cooling by the heatsink 23.

The material of the back-surface inner wall 341 and the back-surface outer wall 342 is preferably metal. This enables improvement in efficiency of transmitting heat directly from the heatsink 23 or via the air in the cover internal space 350 to the back-surface inner wall 341 or the back-surface outer wall 342 and improvement in efficiency of dissipating transmitted heat to the external air. Improving efficiency of dissipation of heat to the back-surface inner wall 341 or the back-surface outer wall 342 increases the amount of heat transmitted via the heatsink 23 and this makes it possible to improve the performance of cooling by the heatsink 23.

The copier 10 has the configuration in which air flows are separated between the cover internal space 350 where an airflow occurs because of a difference in temperature of air and the internal space of the discharge duct, such as the vertical discharge duct 50, and thus the air to be discharged that passes through the discharge duct does not flow into the cover internal space 350.

This prevents the solid particles, such as toner, and odor that are contained in the air to be discharged from passing through the cover internal space 350 and being contained in the air that is discharged from the upper opening 351 and the paper-ejection-side upper opening 353. Accordingly, compared to the configuration in which air in the vertical discharge duct 50 is not cooled and is directly discharged, it is possible to improve the cooling performance and prevent the amount of discharge of solid particle and odor from increasing.

As illustrated in FIGS. 1, 7 and 24, there is a clearance in the anteroposterior direction of the device between the fin holder board 233 and the back-surface inner wall 341 and thus the opening of the back-surface inner wall 341 is not occluded by the fin holder board 233. For this reason, there is a clearance between the edge of the opening of the back-surface inner wall 341 and the heatsink 23 and the air in the device body may enter the cover internal space 350 from the clearance. Thus, an arrangement in which the opening of the back-surface inner wall 341 is also occluded with the fin holder board 233 is preferable. Occluding the opening of the back-surface inner wall 341 makes it possible to separate the inside of the device body from the cover internal space 350, block air from being communicated and thus prevent odor and solid particles caused in the device body from being discharged to the outside of the device via the cover internal space 350.

In the image forming device, there is a risk that stagnation of the heat generated by the heat sources, including the electronic unit, the paper-ejection unit, the fixing unit and the developing unit, may increase the temperature in the device and this may cause failures in operations of the electronic parts and failures in images due to toner adhesion.

To solve such a problem, in the copier 10, heat stagnating in the vicinity of the multiple heat sources is collected together with air in the vertical discharge duct 50 with the discharge duct and the discharge fan. The collected heat is caused to move to the cover internal space 350 between the back-surface inner wall 341 and the back-surface outer wall 341 of the double-layered back-surface exterior cover 34 via the heatsink 23.

Heat absorption in the vertical discharge duct 50 and the heat dissipation in the cover internal space 350 that are performed by the heatsink enables realization of efficient heat discharge using the chimney effect in the cover internal space 350. The heat discharged by the cover internal space 350 is not associated with discharge of air that passes through the vicinity of the printer unit 20 where image forming is performed and that is heated by the heat sources in the printer unit 20 to the outside. This enables discharge of only heat without discharge of noise, odor and solid particles from the ejection opening through which the air in the cover internal space 350 is ejected to the outside of the device.

Figure 26:
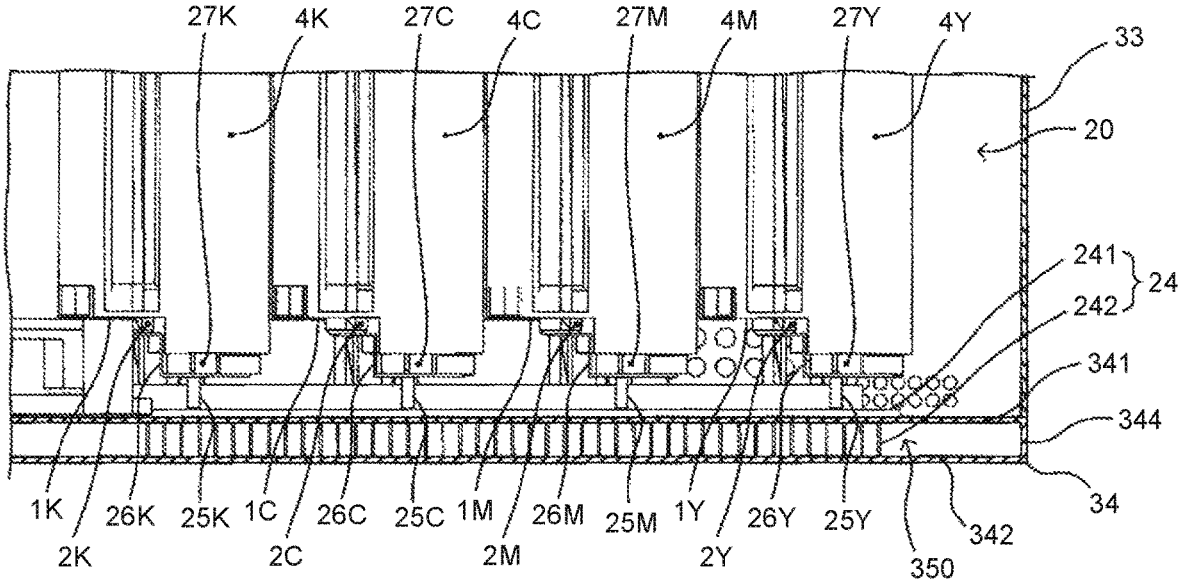
FIG. 26 is a cross-sectional view of the vicinity of the back side end of the printer unit in the copier viewed from the upper side.

FIG. 26 is a cross-sectional view of the vicinity of the back side end of the printer unit 20 in the copier 10 viewed from above. As in FIG. 21, the frame (the back-surface left frame 104) is not illustrated for convenience in FIG. 26.

Each of the four process cartridges 1 includes a unit driver 27 on its back side end and includes a heat transmission board 26 provided as covering the outer side of the back side end of the photoconductors 2, the unit driver 27 and the developing device 4.

The process cartridges 1 further include an image-forming-unit heat dissipation heatsink 24 in a position opposed to the back side of the heat transmission boards 26 and include heat pipes 25 that connect the heat transmission boards 26 and the image-forming-unit heat dissipation heatsink 24.

Figure 27:
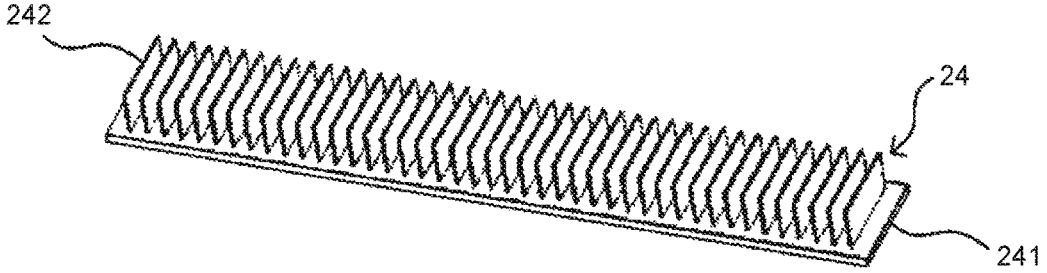
FIG. 27 is a perspective view of an image-forming-unit heat dissipation heatsink.

FIG. 27 is a perspective view of the image-forming-unit heat dissipation heatsink 24 and the image-forming-unit heat dissipation heatsink 24 includes an image-forming-unit heat absorption board 241 and image-forming-unit heat dissipation fins 242. As illustrated in FIG. 26, the image-forming-unit heat dissipation heatsink 24 is arranged such that the image-forming-unit heat absorption board 241 is positioned on the inner-side of device body with the back-surface inner wall 341 interposed between the image-forming-unit heat absorption board 241 and the image-forming-unit heat dissipation fins 242 and that the image-forming-unit heat dissipation fins 242 are positioned on the side of the cover internal space 350 with the back-surface inner wall 341 interposed between the image-forming-unit heat absorption board 241 and the image-forming-unit heat dissipation fins 242.

The heat generated from the unit drivers 27, the developing devices 4, etc., is transmitted to the image-forming-unit heat absorption board 241 via the heat transmission boards 26 and the heat pipes 25 and furthermore is transmitted to the image-forming-unit heat dissipation fins 242 and is dissipated in the cover internal space 350. As the image-forming-unit heat dissipation fins 242 are positioned in the cover internal space 350, the image-forming-unit heat dissipation heatsink 24 is able to dissipate heat efficiently by the chimney effect and thus realize efficient heat discharge.

As illustrated in FIG. 26, the back side ends of the image-forming-unit heat dissipation fins 242 preferably contact the inner wall surface of the back-surface outer wall 342. This enables realization of a configuration in which heat transmitted to the image-forming-unit heat dissipation fins 242 is not only dissipated to the air in the cover internal space 350 but also transmitted to the back-surface outer wall 342 not via air from the image-forming-unit heat dissipation fins 242 and is dissipated to the external air from the outer wall surface of the back-surface outer wall 342. Such a configuration enables improvement of the performance of cooling by the image-forming-unit heat dissipation heatsink 24.

The copier 10 includes, as the sheet conveyance path that conveys the transfer paper P that is a sheet, the fed-paper conveyance path 17 and the inversion conveyance path 18. The copier 10 further includes the printer unit 20 that is the image forming unit that forms an image on the transfer paper P, the vertical discharge duct 50 and the horizontal discharge duct 51 that serve as the discharge path that guides air to be discharged that is discharged from the printer unit 20 to the outside of the device. The vertical discharge duct 50 and the horizontal discharge duct 51 that form the discharge path are provided on the outer side with respect to the printer unit 20 in the left-right direction of the device body in the case where the sheet-width direction intersecting the direction in which the transfer paper P is conveyed in the fed-paper conveyance path 17 and the inversion conveyance path 18 is the anteroposterior direction of the device body. In the copier 10, providing the discharge path on the outer side of the printer unit 20, including the fed-paper conveyance path 17 and the inversion conveyance path 18, in the left-right direction enables more space saving in the anteroposterior direction than that in the configuration in which the discharge path is provided on the outer side of the printer unit 20 in the anteroposterior direction.

The copier 10 includes the jamming process pivoter 81 serving as a conveyance path cover member that moves to the outer side in the left-right direction and thus enters the opened state from the closed state to expose the fed-paper conveyance path 17 and the inversion conveyance path 18. The copier 10 includes the casing 100 in which the move area α that is the cover-member open-close-time passing-through area, through which the jamming process pivoter 81 passes when moving between the closed state and the opened state, is positioned. Furthermore, the vertical discharge duct 50 and the horizontal discharge duct 51 are arranged in the casing 100. In the copier 10, as the move area α is positioned in the casing 100, it is unnecessary to secure a space for opening and closing the jamming process pivoter 81 on the outer side of the copier 10 in the left-right direction. Thus, as illustrated in FIG. 13, it is possible to arrange the copier 10 with its lateral side surface being close to or contacting other objects, such as the cabinets 300.

The vertical discharge duct 50 and the horizontal discharge duct 51 are provided in the free area in the internal space (the jamming process space 30) of the casing 100 extended in the left-right direction of the printer unit 20 in order to secure the space (move area α) for the jamming process pivoter 81 that moves in the left-right direction to open and close. This inhibits the size of the entire copier 10 from increasing.

As for transfer of heat by the heat conductor, such as the heatsink 23, the larger the difference between the temperature in a location where a heat absorber is arranged and the temperature in a location where a heat dissipator is arranged is, the more heat can be transferred efficiently. In the copier 10, the air to be discharged that is heated by each heat source is collected and the heat absorption fins 231 of the heatsink 23 are arranged in the vertical discharge duct 50 in which the temperature of internal air tends to be high. Arranging the heat absorber in the location where the heat to be discharged is collected enables more efficient heat transfer than that enabled by a configuration in which the heat absorber is arranged in another location on the discharge path and thus enables improvement of efficiency of cooling the vertical discharge duct 50 using the heatsink 23.

In the copier 10, the vertical discharge duct 50 and the back-surface exterior cover 34 that are connected via the heatsink 23 are arranged as being close to each other. Alternatively, the vertical discharge duct 50 and the back-surface exterior cover 34 may separate from each other. As for heat transfer by the heat conductor, such as the heatsink 23, the shorter the distance from the heat absorber to the heat dissipator is, the more heat can be transferred efficiently.

In the copier 10, the back-surface exterior cover 34 that is part of the exterior cover that houses the heat sources including the upper electronic unit 60, the fixing device 12 and the process cartridges and the discharge paths including the vertical discharge duct 50 is double-layered and forms the cover internal space 350. Forming the cover internal space 350 that is a wall internal space in the exterior cover enables realization of a configuration in which the air in the discharge path is cooled by using the airflow caused by the difference in temperature of air without addition of any member to form the wall internal space.

Even a configuration in which the lower opening 352 of the cover internal space 350 is in a position above the heat dissipation fins 232 of the heatsink 23 enables cooling by the chimney effect as long as the configuration causes air between the lower opening 352 and the upper opening 351 in the cover internal space 350 to be heated by the heat dissipation fins 232. When the lower opening 352 is in a position above the heat dissipation fins 232, air that is heated by the heat dissipation fins 232 and is to move upward also flows out of the lower opening 352 and efficiency of cooling by the chimney effect lowers. On the other hand, positioning the lower opening 352 under the heat dissipation fins 232 enables prevention of air that is heated by the heat dissipation fins 232 and is to go upward from flowing out of the lower opening 352 and enables improvement of efficiency of cooling by the chimney effect.

Modification

In the copier 10 in the above-described embodiment, the double-layered exterior cover that forms the cover internal space 350 is the back-surface exterior cover 34. The double-layered exterior cover that forms the cover internal space 350 is not limited to the back-surface exterior cover 34.

The copier 10 in which the right-surface exterior cover 32 and the left-surface exterior cover 33 are double-layered exterior covers each forming the cover internal space 350 will be described below as a modification.

Figure 28:
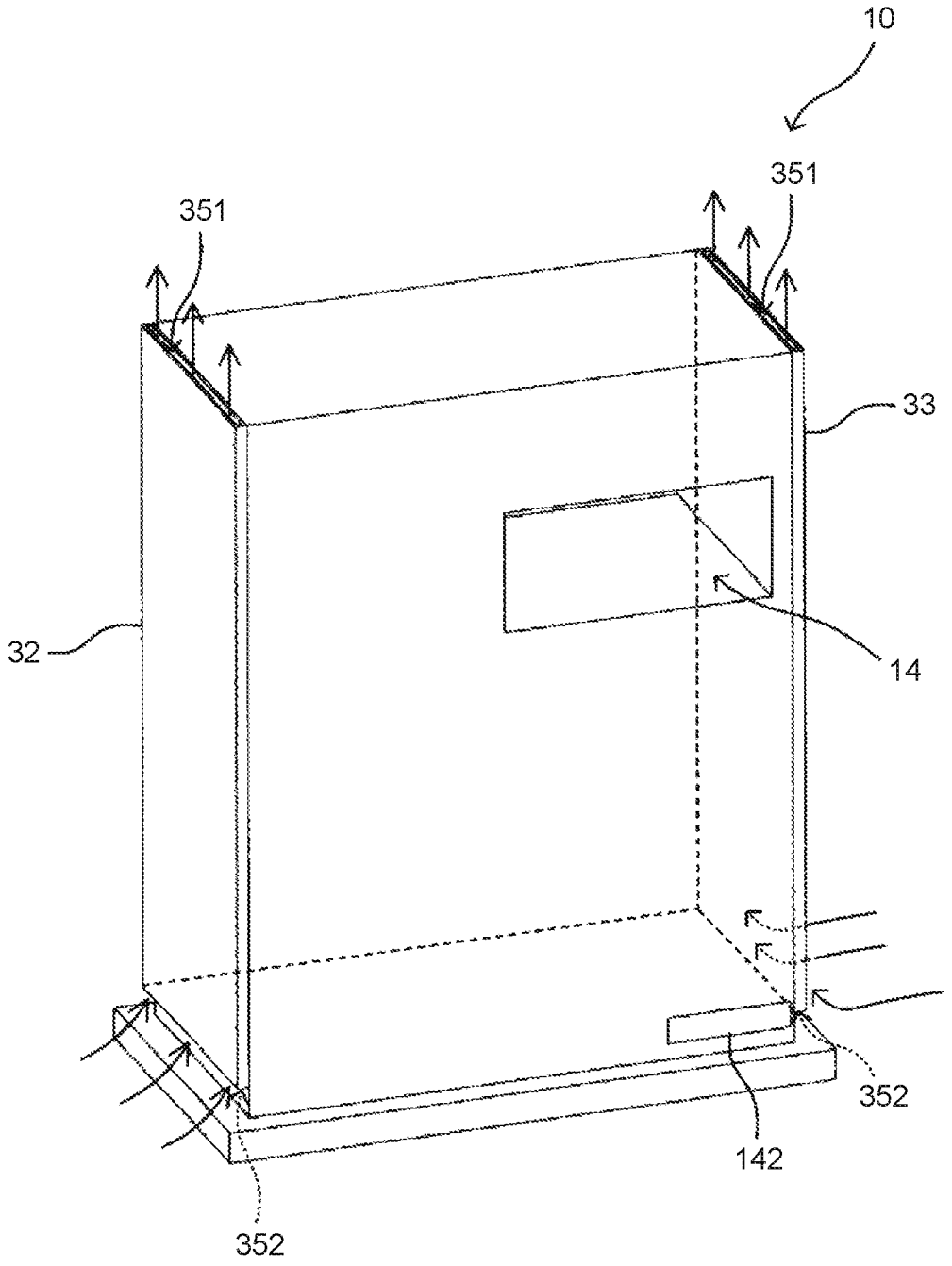
FIG. 28 is a perspective view of a copier of a modification viewed from the right back side.

FIG. 28 is a perspective view of the copier 10 of the modification viewed from the right back side. The arrows in FIG. 28 represent an air flow in which external air flows into the cover internal spaces 350 from the lower openings 352 and the air in the cover internal spaces 350 flows out of the device to the outside from the upper openings 351 and the paper-ejection-side upper opening 353.

Figure 29:
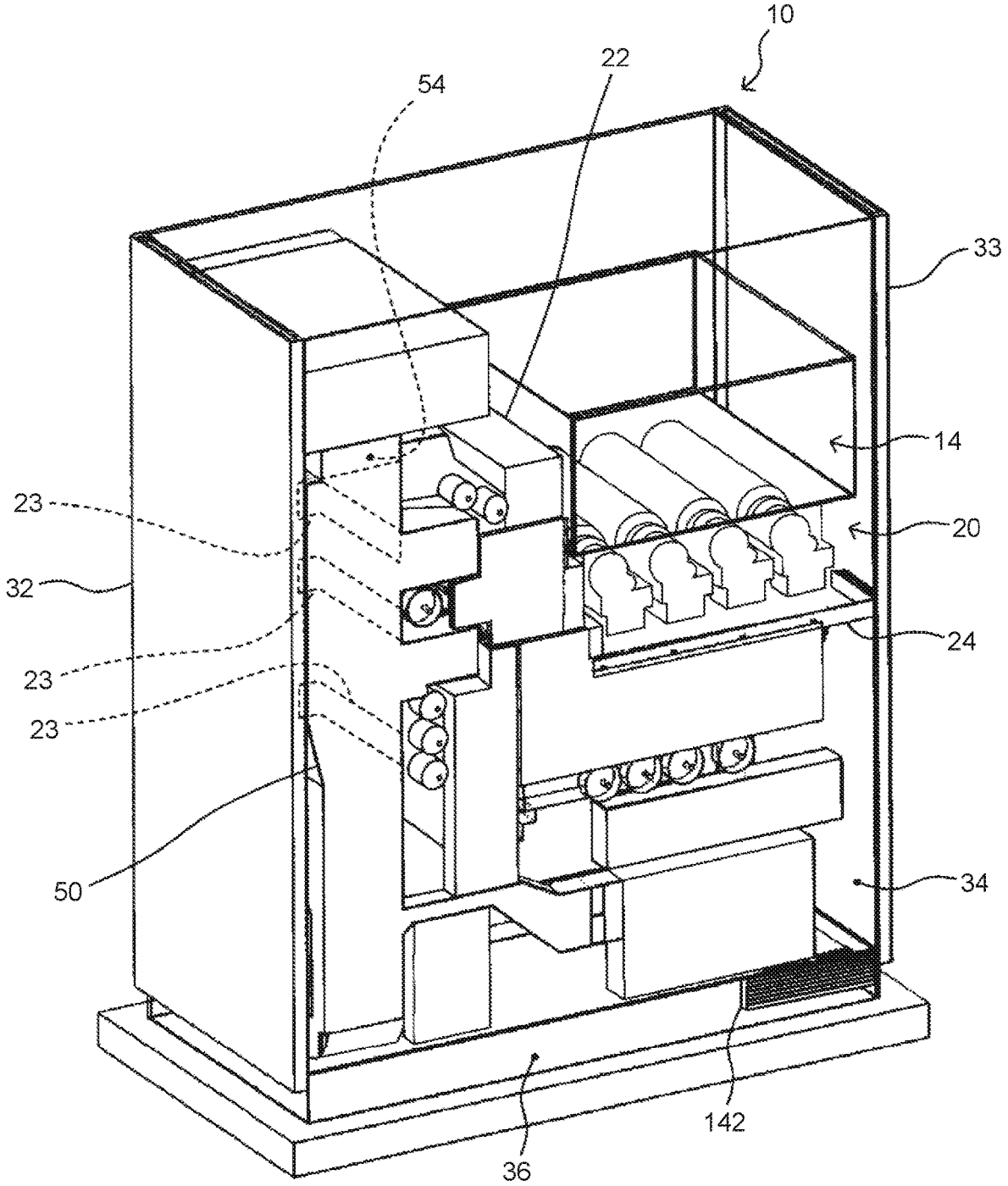
FIG. 29 is a perspective view of the copier of the modification viewed from the same same direction as that in FIG. 28.

FIG. 29 is a perspective view of the copier 10 of the modification viewed from the same direction as that in FIG. 28 and is a perspective view of the back-surface exterior cover 34. As in FIG. 21, the frames are not drawn in FIG. 29 for convenience.

The copier 10 of the modification is different from the copier 10 of the embodiment in that the double-layered exterior cover forming the cover internal space 350 includes the right-surface exterior cover 32 and the left-surface exterior cover 33 and in the configurations of the heatsink 23 and the image-forming-unit heat dissipation heatsink 24 that transmit the heat to each of the right-surface exterior cover 32 and the left-surface exterior cover 33. Other aspects are the same as those of the copier 10 of the embodiment and thus only the differences will be described.

Figure 30:
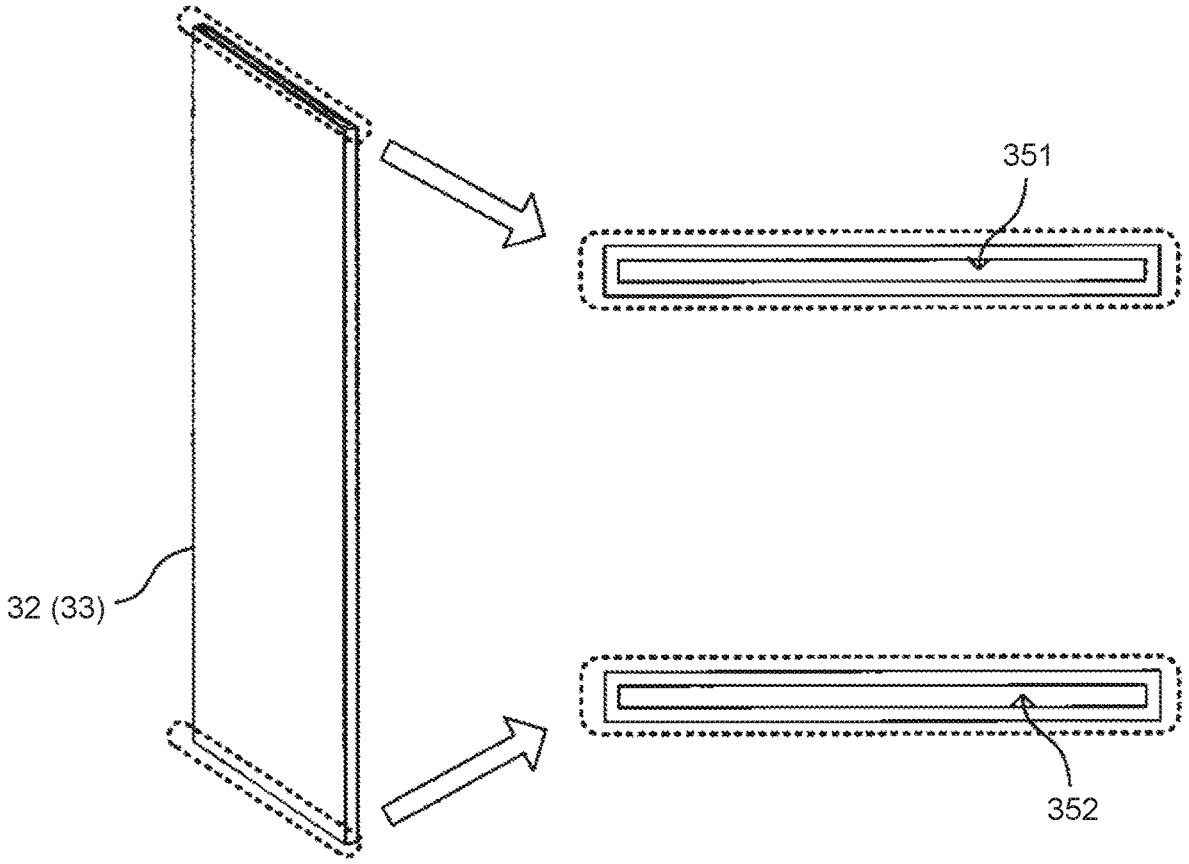
FIG. 30 is an illustration of a right-surface exterior cover of the copier 10 of the modification.

FIG. 30 is a diagram illustrating the right-surface exterior cover 32 (or the left-surface exterior cover 33) of the copier 10 of the modification. As illustrated in FIG. 30, the right-surface exterior cover 32 (or the left-surface exterior cover 33) includes the upper opening 351 as the opening through which the air flow having passed through the cover internal space 350 is ejected. The back-surface exterior cover 34 includes the lower opening 352 as an opening through which an air flow to pass though the cover internal space 350 is sucked.

The copier 10 of the modification has a configuration in which the heat in the vertical discharge duct 50 is dissipated from the right-surface exterior cover 32 and the heat that is transmitted via the heat pipe 25 not via air from the process cartridges 1 is dissipated from the left-surface exterior cover 33.

As represented by the dashed lines in FIG. 29, in the copier 10 of the modification, the three heatsinks 23 are arranged in the top-down direction of the vertical discharge duct 50.

Figure 31:
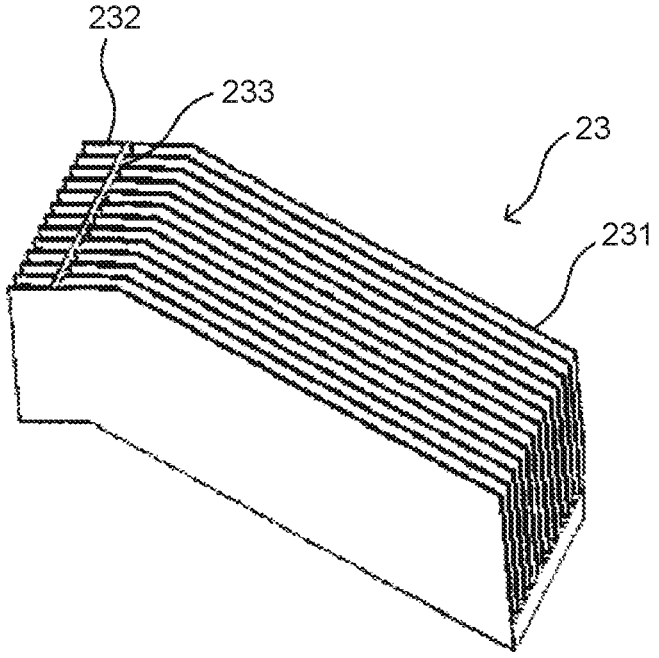
FIG. 31 includes illustrations of a heatsink that the copier of the modification includes.
Figure 31:
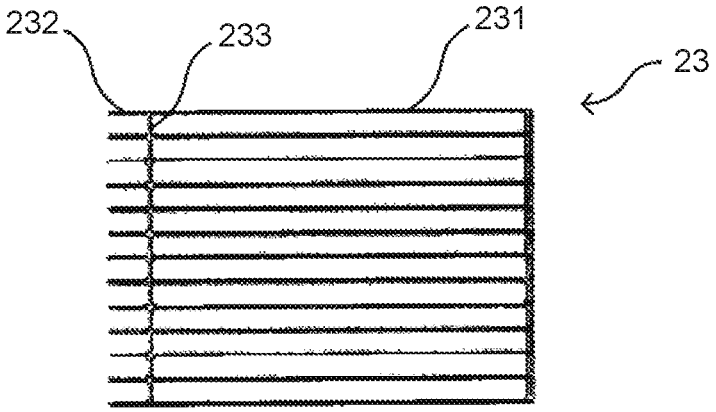

FIG. 31 is an illustration of the heatsink 23 of the copier 10 of the modification. A section (a) of FIG. 31 is a perspective view of the heatsink 23 and a section (b) of FIG. 31 is a top view of the heatsink 23.

In the copier 10 of the modification, the heatsink 23 is arranged with the heat absorption fins 231 being positioned in the vertical discharge duct 50 and the heat dissipation fins 232 being positioned in the cover internal space 350 that is formed by the right-surface exterior cover 32. This enables dissipation of the heat in the vertical discharge duct 50 into the cover internal space 350 that is formed by the right-surface exterior cover 32 and thus enables efficient heat discharge using the chimney effect in the right-surface exterior cover 32.

Figure 32:
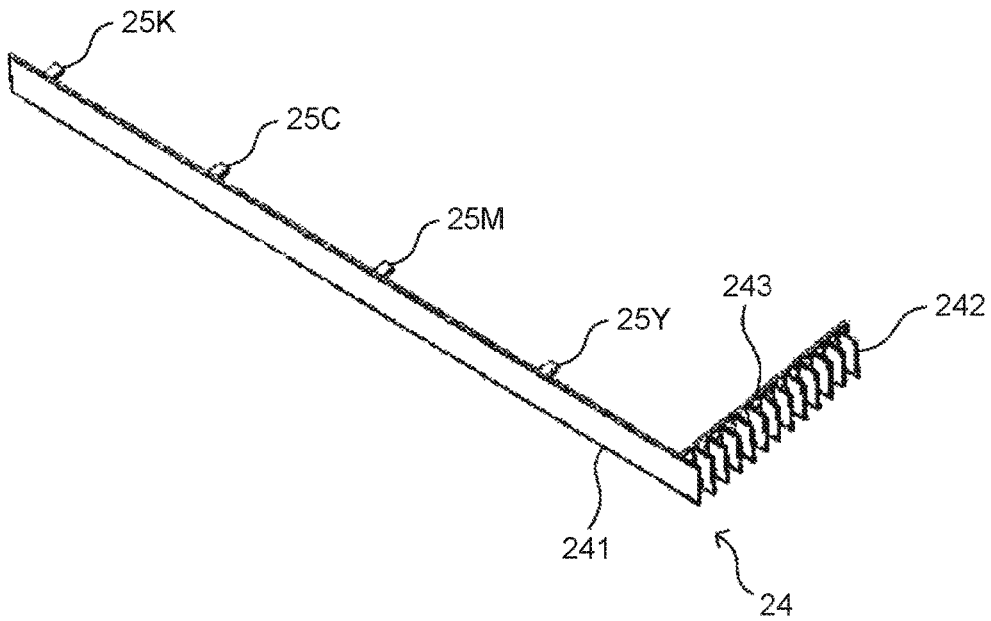
FIG. 32 is a perspective illustration of the image-forming-unit heat dissipation heatsink and heat pipes that the copier of the modification includes.

FIG. 32 is a perspective view illustrating the image-forming-unit heat dissipation heatsink 24 and the heat pipes 25 that the copier 10 of the modification includes. The image-forming-unit heat dissipation heatsink 24 of the modification includes an image-forming-unit fin holding board 243 between the image-forming-unit heat absorption board 241 and the image-forming-unit heat dissipation fins 242 and is in a shape different from the image-forming-unit heat dissipation heatsink 24 of the embodiment in which the image-forming-unit heat dissipation fins 242 are arranged on the back side of the image-forming-unit heat absorption board 241.

In the copier 10 of the modification, the image-forming-unit heat dissipation heatsink 24 is arranged with the image-forming-unit heat absorption board 241 contacting the heat pipes 25 and with the image-forming unit heat dissipation fins 242 being positioned in the cover internal space 350 that is formed by the left-surface exterior cover 33. Accordingly, heat that is absorbed by the heat transmission board 26 at the back side end of the process cartridges 1 is dissipated in the cover internal space 350 that is formed by the left-surface exterior cover 33 and thus efficient heat discharge using the chimney effect in the left-surface exterior cover 33 can be realized.

As in the embodiment, the copier 10 of the modification includes the air outlet 53 to discharge air (air to be discharged) having passed thought the discharge duct on the front side of the copier 10. The lower openings 352 that are the openings through which air flows to pass though the cover internal spaces 350 of the right-surface exterior cover 32 and the left-surface exterior cover 33 are sucked are positioned on both right and left side surfaces. This is a configuration in which the position in which the air to be discharged that is heated by the heat sources is discharged and the position of the opening through which the air flow to pass through the cover internal space 350 is sucked are separate from each other and the configuration prevents a failure that the air to be discharged whose temperature has increased to a temperature higher than that of the external air flows into the cover internal space 350 and thus the cooling effect lowers. Furthermore, the user is prevented from getting the discharged air via the cover internal space 350.

The above-described embodiment and modification are examples only and specific effects are produced in each of the following modes.

Mode 1

An electronic device, such as the copier 10 including a heat source, such as the fixing device 12 and the process cartridge 1; and a discharge path, such as the vertical discharge duct 50, that guides a gas, such as air, in the device, such as a device body, toward the outside of the device is characterized by including a wall internal space, such as the cover internal space 350, that is surrounded by walls, such as the back-surface inner wall 341, the back-surface outer wall 342, the back-surface right wall 343 and the back-surface left wall 344, that extends vertically, and that is open to a space outside the device via the upper opening 351 and the lower opening 352 that are in different vertical positions; and a heat conductor including a heat absorber, such as the heat absorption fins 231, that is positioned in the discharge path and a heat dissipator that is positioned in the wall internal space.

The heat discharge ability of a configuration to discharge heat by discharging a heated gas via the discharge path to the outside depends on the temperature and amount of flow of the gas in the discharge path. An increase in the amount of heat that is generated by the heat source may cause insufficient heat discharge and thus may cause insufficient inhibition of the temperature of the device body from increasing.

In Mode 1, when the temperature in the discharge path becomes higher than that of the wall internal space, the heat absorber of the heat conductor absorbs the heat in the discharge path and the heat dissipator dissipates the heat in the wall internal space. Heat dissipation in the inter-dissipation space heats the gas in the inner-wall space and the gas whose temperature has increased reduces in density and becomes light and thus rises. When the gas in the inner-wall space that is surrounded by the walls and that extends vertically rises, the gas outside the device enters the inner-wall space from the lower opening by the so-called chimney effect, which causes an airflow to pass through the wall internal space and be discharged to the outside of the device from the upper opening. This airflow continuously replaces the gas in the wall internal space and thus it is possible to prevent the gas that is heated by the heat dissipation from the heat dissipator from being stagnant around the heat dissipator and continuously dissipate heat from the heat dissipator. For this reason, the heat absorber of the heat conductor is able to continuously absorb the heat in the discharge path and thus lower the temperature of the gas in the discharge path. Accordingly, it is possible to improve the heat discharge ability of the configuration to discharge heat by discharging the heated gas to the outside via the discharge path and thus inhibit the temperature in the device from increasing excessively.

Mode 2

The electronic device according to Mode 1 is characterized in that an exterior cover, such as the back-surface exterior cover 34, that houses at least the heat source and the discharge path is a double-layered structure including an inner cover, such as the back-surface inner wall 341, and an outer cover, such as the back-surface outer wall 342, and the wall internal space is formed between the inner cover and the outer cover.

This enables realization of a configuration to cool the gas in the discharge path by using the chimney effect without adding any member go form the wall internal space as described in the above-described embodiment.

Mode 3

The electronic device according to Mode 2 is characterized in that the heat conductor contacts the outer cover.

This enables not only cooling by the chimney effect but also cooling by transmitting heat from the heat conductor to the outer cover and dissipating the heat from the outer wall surface of the outer cover to the outside of the device and thus enables further heat dissipation effects as described in the above-described embodiment.

Mode 4

The electronic device according to Mode 2 or 3 is characterized in that the material of the inner cover and the outer cover is metal.

This enables improvement of efficiency of heat transmission to the inner cover or the outer cover and efficiency of heat dissipation from the inner cover and the outer cover to the outside of the device and thus enables improvement of the performance of cooling by the heat conductor as described in the above-described embodiment.

Mode 5

The electronic device according to any one of Modes 1 to 4 is characterized in that the heat dissipator of the heat conductor is positioned between the upper opening and the lower opening in the vertical direction in the wall internal space.

This enables improvement of efficiency of cooling by the chimney effect as described in the above-described embodiment.

Mode 6

The electronic device according to any one of Modes 1 to 5 is characterized in that the discharge path has a shape in which multiple paths, such as the image-forming-unit discharge duct 61, the fixing-unit discharge duct 63 and the paper-ejection-unit discharge duct 65, join together and are directed to the outside of the device and the heat absorber of the heat conductor is in a position where the multiple paths join together in the discharge path or in a position inside the discharge path (in the vertical discharge duct 50) on a downstream side with respect to the position in a direction in which the gas moves.

This enables arrangement of the heat absorber in a location where discharged heat is collected and thus enables improvement of efficiency of cooling the discharge path using the heat conductor as described in the above-described embodiment.

Mode 7

The electronic device according to any one of Modes 1 to 6 is characterized by including a blowing device, such as the first discharge fan 54 and the second discharge fan 55, that causes an airflow in the discharge path.

This makes it possible to, using the configuration to cause an airflow in the discharge path to discharge heat, cool the gas in the discharge path by the airflow from the chimney effect via the heat conductor as described in the above-described embodiment. This enables improvement of cooling performance of the configuration to cause an airflow in the discharge path for cooling without increasing the output of the blowing device.

Mode 8

The electronic device according to any one of Modes 1 to 7 is characterized by including a heatsink, such as the image-forming-unit heat dissipation heatsink 24, including a heat dissipator, such as the image-forming-unit heat dissipation fins 242, inside the wall internal space and a heat pipe, such as the heat pipes 25, that connects the heat source, such as the process cartridges 1, and the heatsink.

This enables use of an airflow caused by the chimney effect to dissipate heat for heat transfer with the heat pipe and the heatsink and thus enables realization of efficient heat discharge as described in the above-described embodiment.

Mode 9

The electronic device according to any one of Modes 1 to 8 is characterized by including an air inlet, such as the front-side air inlet 42, through which a gas outside the device is sucked and an air outlet, such as the air outlet 53, through which the gas having passed through the discharge path is discharged to the outside, the air inlet and the air outlet being in a front surface of the device, such as the front lower exterior cover 35 and the jamming-processor front cover 31.

This enables arrangement in which the back surface and side surfaces of the electronic device are close to or contact other objects, such as a cabinet and a wall, as described in the above-described embodiment.

Mode 10

An image forming device, such as the copier 10, that forms an image on a recording medium, such as the transfer paper P, is characterized by including a configuration of the electronic device according to any one of Modes 1 to 9.

This enables inhibition of the temperature in the device from increasing excessively and thus enables prevention of occurrence of failures in operations of electronic parts resulting from an increase in temperature in the device and failures in images due to toner adhesion as described in the above-described embodiment.

According to the present invention, there is an excellent effect that a configuration to discharge heat via a discharge path inhibits the temperature in the device from increasing excessively.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An electronic device comprising:

a heat source; and a discharge path configured to guide a gas toward the outside of the device;

a wall internal space that is defined by walls, that extends vertically, and that is open to the space outside the device via an upper opening and a lower opening that are in different vertical positions;

a heat conductor including a heat absorber in the discharge path and a heat sink including a heat dissipator in the wall internal space; and a heat pipe that connects the heat source and the heat conductor.

2. An electronic device comprising, a heat source;

a discharge path configured to guide a gas toward the outside of the device;

a wall internal space that is defined by walls, that extends vertically, and that is open to a space outside the device via an upper opening and a lower opening that are in different vertical positions; and a heat conductor including a heat absorber in the discharge path and a heat dissipator in the wall internal space;

an exterior cover that houses at least the heat source and the discharge path is a double-layered structure including an inner cover and an outer cover, and the wall internal space is between the inner cover and the outer cover.

3. The electronic device according to claim 2, wherein the heat conductor contacts the outer cover.

4. The electronic device according to claim 2, wherein a material of the inner cover and the outer cover is metal.

5. The electronic device according to claim 1, wherein the heat dissipator of the heat conductor is between the upper opening and the lower opening in the vertical direction in the wall internal space.

6. An electronic device comprising, a heat source;

a discharge path configured to guide a gas toward the outside of the device;

a wall internal space that is defined by walls, that extends vertically, and that is open to a space outside the device via an upper opening and a lower opening that are in different vertical positions; and a heat conductor including a heat absorber in the discharge path and a heat dissipator in the wall internal space;

the discharge path has a shape in which multiple paths join together and are directed to the outside of the device, and the heat absorber of the heat conductor is where the multiple paths join together in the discharge path or inside the discharge path on a downstream side with respect to a direction in which the gas moves.

7. The electronic device according to claim 1, further comprising a blowing device that causes an airflow in the discharge path.

8. The electronic device according to claim 1, further comprising:

an air inlet through which a gas outside the device is sucked and an air outlet through which the gas having passed through the discharge path is discharged to the outside, the air inlet and the air outlet being in a front surface of the device.

9. An image forming device that forms an image on a recording medium, the device comprising a configuration of the electronic device according to claim 1.

* * * * *